US010074952B2

(12) United States Patent
Bogart

(10) Patent No.: US 10,074,952 B2
(45) Date of Patent: Sep. 11, 2018

(54) METHOD FOR ASSEMBLING AND INSTALLING A PORTABLE POWER CONNECTOR

(71) Applicant: Integro LLC, New Britain, CT (US)

(72) Inventor: John Bogart, Oxford, CT (US)

(73) Assignee: Integro, LLC, New Britain, CT (US)

( * ) Notice: Subject to any disclaimer, the term of this patent is extended or adjusted under 35 U.S.C. 154(b) by 261 days.

(21) Appl. No.: 14/951,784

(22) Filed: Nov. 25, 2015

(65) Prior Publication Data

US 2016/0079723 A1 Mar. 17, 2016

Related U.S. Application Data

(62) Division of application No. 13/770,274, filed on Feb. 19, 2013, now Pat. No. 9,203,191.

(60) Provisional application No. 61/600,273, filed on Feb. 17, 2012.

(51) Int. Cl.

| | |
|---|---|
| ***H01R 43/20*** | (2006.01) |
| ***H01R 43/16*** | (2006.01) |
| ***H01R 13/639*** | (2006.01) |
| ***H01R 13/42*** | (2006.01) |
| ***H01R 43/00*** | (2006.01) |
| ***H01R 13/213*** | (2006.01) |
| *H01R 13/56* | (2006.01) |
| *H01R 4/36* | (2006.01) |

(52) U.S. Cl.

CPC ..... *H01R 43/16* (2013.01); *H01R 13/213* (2013.01); *H01R 13/42* (2013.01); *H01R 13/6392* (2013.01); *H01R 43/00* (2013.01); *H01R 4/36* (2013.01); *H01R 13/56* (2013.01); *Y10T 29/49174* (2015.01)

(58) Field of Classification Search

CPC .. H01R 13/213; H01R 13/42; H01R 13/6392; H01R 43/00; H01R 43/36; H01R 43/56

See application file for complete search history.

(56) References Cited

U.S. PATENT DOCUMENTS

| | | | | |
|---|---|---|---|---|
| 3,689,866 | A | 9/1972 | Kelly | |
| 5,957,564 | A | 9/1999 | Bruce et al. | |
| 6,309,258 | B1 | 10/2001 | Measley | |
| 6,367,952 | B1 | 4/2002 | Gibboney, Jr. | |
| 6,787,717 | B2 * | 9/2004 | Jorczak ..... | H01H 9/161 200/17 R |
| 7,114,840 | B2 | 10/2006 | Hamrick | |

(Continued)

OTHER PUBLICATIONS

International Search Report and Written Opinion issued in PCT Application No. PCT/US2013/024625 dated Apr. 12, 2013.

*Primary Examiner* — Paul D Kim
(74) *Attorney, Agent, or Firm* — MKG, LLC

(57) ABSTRACT

A method for assembling and installing a power connector on a cable includes providing female and male connectors having a tapered insulator and a contact defining a set screw contact having at least one first radial aperture. A first set screw engages the at least one first radial aperture and a second set screw engages the at least one second radial aperture. Each of the first and second set screws define an outer surface and a bore extending at least partway therethrough. A first retaining screw engages the bore of the first set screw and corresponding aperture in the female connector. A second retaining screw engages the bore of the second set screw and corresponding aperture in the male connector.

18 Claims, 22 Drawing Sheets

(56) References Cited

U.S. PATENT DOCUMENTS

| | | | | |
|---|---|---|---|---|
| 7,892,047 | B2 | 2/2011 | Strickland, Jr. | |
| 9,122,967 | B2 | 9/2015 | King | |
| 9,362,688 | B2 * | 6/2016 | Bogart | H01R 13/6392 |
| 2004/0109330 | A1 | 6/2004 | Pare | |
| 2006/0204731 | A1 | 9/2006 | Wani et al. | |
| 2007/0153518 | A1 | 7/2007 | Chen | |
| 2007/0256597 | A1 | 11/2007 | Rukavina et al. | |
| 2009/0142952 | A1 * | 6/2009 | Akasaka | H01R 13/622 439/314 |
| 2009/0264000 | A1 | 10/2009 | Ikeda et al. | |
| 2009/0308795 | A1 | 12/2009 | Smith | |
| 2010/0184318 | A1 | 7/2010 | Bogart et al. | |
| 2010/0282446 | A1 | 11/2010 | Yamamoto et al. | |
| 2010/0301729 | A1 | 12/2010 | Simon et al. | |
| 2011/0136394 | A1 | 6/2011 | Mostoller et al. | |
| 2011/0158592 | A1 | 6/2011 | Kerr et al. | |
| 2011/0263330 | A1 | 10/2011 | Weston et al. | |
| 2012/0176037 | A1 | 7/2012 | Lee | |

* cited by examiner

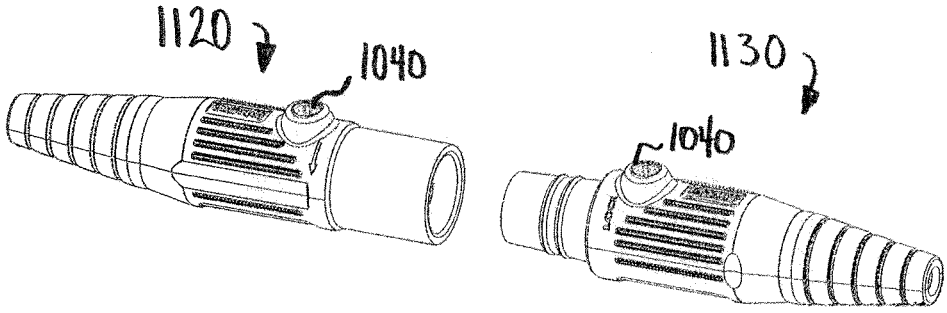
FIG. 22A
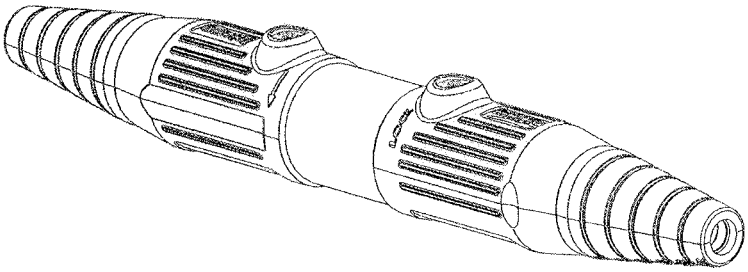
FIG. 22B
| DEVICE AMPACITY TABLE | | |
|---|---|---|
| Cable Size AWG | 75°C Cable | 90°C Cable |
| #2 | 170 | 190 |
| #1 | 195 | 220 |
| 1/0 | 230 | 260 |
| 2/0 | 265 | 300 |
| 3/0 | 310 | 350 |
| 4/0 | 360 | 400 |
| | | |
FIG. 23

METHOD FOR ASSEMBLING AND INSTALLING A PORTABLE POWER CONNECTOR

CROSS-REFERENCE TO RELATED APPLICATION

This application is a divisional application of U.S. patent application Ser. No. 13/770,274 filed on Feb. 19, 2013, now U.S. Pat. No. 9,203,191, which in turn claims the benefit of U.S. Provisional Patent Application Ser. No. 61/600,273, filed on Feb. 17, 2012, which applications are incorporated herein by reference in their entirety.

TECHNICAL FIELD

The present invention is directed to providing portable power to remote locations or providing temporary power during power outages. More particularly, the present invention is directed to improved portable power connectors for power cables used to distribute power to remote locations or during temporary power outages.

BACKGROUND

The ability to draw power from a portable power source is necessary to guarantee that vital functions can continue to operate when a standard power source has been shut down, interrupted or is not locally available. It is common for a portable power source such as a generator, powered by diesel fuel or another non-electrical power source, to be installed at a site or location to provide power. Typically, the portable power source includes panel-mount receptacles installed thereon for receiving plugs extending from extension cables or other cables for use in distributing power. Standardized connectors are installed on one or both ends of the power cable, and are in electrical communication with the power cable, to provide an electrical connection between and among multiple power cables. Such connectors typically have a cam-type connector where the installer inserts the connector into a corresponding receptacle, and twists the connector so that it locks into place within the corresponding receptacle and provides a reliable electrical connection therebetween. This type of connection is necessary to ensure that the connector is not pulled out of the receptacle under inadvertent force or strain.

It is common for the portable power source to provide high-amperage electrical service that may be carried over long lengths of power cables to distribute power to users. For example, the portable power source may provide power that is rated at between one hundred amps at six hundred volts (100 A, 600V), and six hundred amps at two thousand volts (600 A, 2,000V). Standard electrical cable sizes used to distribute power at such a rating include, for example, Type W Single Conductor Portable Round Power Cable such as 2 AWG Type W Portable Power Cable through 4/0 AWG Type W Portable Power Cable.

The power supplied by the portable power source may be reduced to lower amperage and voltage ratings down the line so that various power-rated equipment can be utilized. Often, the distribution of power from the portable power source is dependent upon a series of male-to-female electrically connected extension cords that are placed in electrical communication with power distribution boxes. It is common for installers in the field to assemble these male and female connectors onto the electrical cable. Alternatively, such extension cables are available that include such connectors and are delivered to the field in a ready-to-use condition.

The existing electrical connectors are very difficult to assemble. Since there are large current-carrying loads on these extensions, a poor connection can lead to damaged equipment, injury and general economic and non-economic losses. There also are numerous options relating to size, features, and material of the connector components. As a result, it often is extremely difficult to effectively order the correct material for a particular installation. Moreover, installation of the connectors is problematic because it is difficult to align the connector components, for example a brass contact within an insulator boot, correctly. For example, if the brass contact can spin inside the connection, it often results in a failed connector. Similarly, positioning of a set screw is difficult and if positioned incorrectly, can lead to a failed connector. The installation of connectors onto a power connector typically encompasses only a mechanical fit where the cable enters the back end of the connector insulator boot. It is practically impossible to prevent water ingress therein unless tape, heat-shrink or another suitable material is applied which increases installation time, increases costs and does not always prevent such water ingress. Often, the connectors are obtained from more than one manufacturer or supplier such that the connectors are not consistent among each other. As a result of such cross-pollination of differing connectors, additional problems arise with making a solid and secure electrical connection.

SUMMARY

In one aspect, the present invention resides in a method for assembling and installing a power connector on a cable. The method includes providing a power connector having a first end, a second end, and a midsection. The method further includes providing a female connector having a tapered female insulator defining a first taper extending radially outwardly from the first end and tapering axially inward to the midsection, and a female contact defining a first set screw contact having at least one first radial aperture. A male connector is also provided having a tapered male insulator defining a second taper extending radially outwardly from the second end and tapering axially inward to the midsection, and a male contact defining a second set screw contact having at least one second radial aperture. A first set screw engages the at least one first radial aperture and a second set screw engages the at least one second radial aperture. Each of the first and second set screws define an outer surface and a bore extending at least partway therethrough. A first retaining screw engages the bore of the first set screw and corresponding aperture in the female connector. A second retaining screw engages bore of the second set screw and corresponding aperture in the male connector.

In another aspect, the present invention resides in a method for assembling and installing one of a female or male connector on a cable. The method includes measuring a diameter $D_C$ of the cable, identifying a tapered segment of an insulator wherein the tapered segment defines a bore therein corresponding to diameter $D_C$, cutting the insulator at a groove located immediately axially outward of the tapered segment, sliding the cable through the insulator, removing a first portion of cable insulation to expose a conductor, wrapping a first portion of a strain relief member around a second portion of cable insulation and extending a second portion of the strain relief member along the exposed conductor, wrapping a conductive foil around the exposed conductor and the second portion of the strain relief wire to form a wrapped conductor, guiding the insulator onto the cable until the second portion of the strain relief member is positioned diametrically opposite a retaining screw aperture formed in the insulator, selecting an electrically conductive contact from among a female and male contact and inserting the wrapped conductor into the contact, threadedly engaging one or more set screws within corresponding apertures defined in the contact, assuring that the contact is fully seated within the insulator such that the threaded retaining screw aperture is aligned with at least one of the set screws, and driving a retaining screw into the retaining screw aperture of the insulator.

BRIEF DESCRIPTION OF THE DRAWINGS

FIG. 10A is top schematic view of another embodiment of the female contact of FIG. 6.

FIG. 10B is a cross-section view of the female contact of FIG. 10A taken along line A-A of FIG. 10A.

FIG. 10C is a schematic view of one end of the female contact of FIG. 10A.

FIG. 10D is side schematic view of the female contact of FIG. 10A.

FIG. 10E is a schematic view of another end of the female contact of FIG. 10A.

FIGS. 22A-22B provide a graphical representation of a method of connecting a female and male connector of FIG. 1 or FIG. 4.

FIG. 23 provides a device ampacity table based a size of a standard power cable.

DETAILED DESCRIPTION

Figure 1:
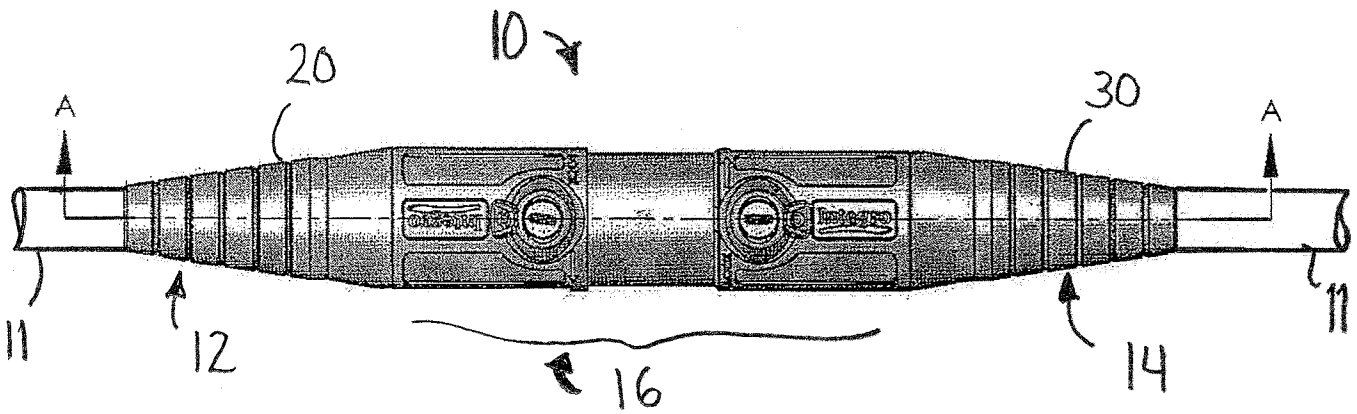
FIG. 1 is a top view of one embodiment of a portable power connector of the present invention.

An electrical connector 10 in accordance with one embodiment of the present invention is designated generally by the reference number 10 and is hereinafter referred to as "connector 10" and is depicted in FIG. 1. One or more connectors 10 are installed on one or both ends of a power cable 11, and are configured for coupling with the power cable 11 to provide an electrical connection between and among multiple power cables. The connector 10 defines a first end 12, a second end 14, and a midsection 16. A cross-section of the connector 10 taken along line A-A of FIG. 1 is provided in FIG. 2, and an exploded perspective view of the connector 10 is provided in FIG. 3.

Figure 2:
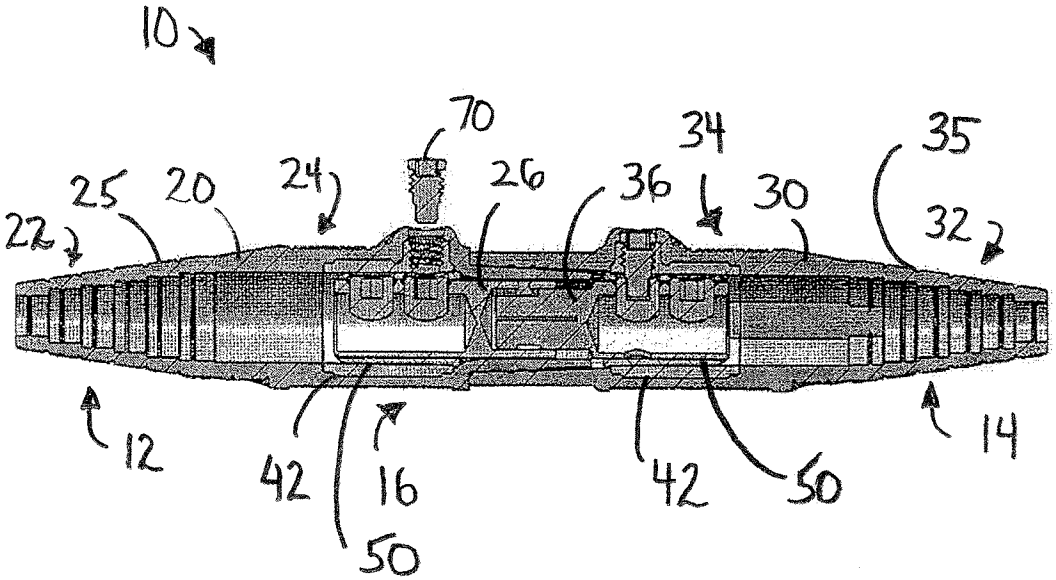
FIG. 2 is a cross-section view of the portable power connector of FIG. 1 taken along line A-A of FIG. 1.
Figure 3:
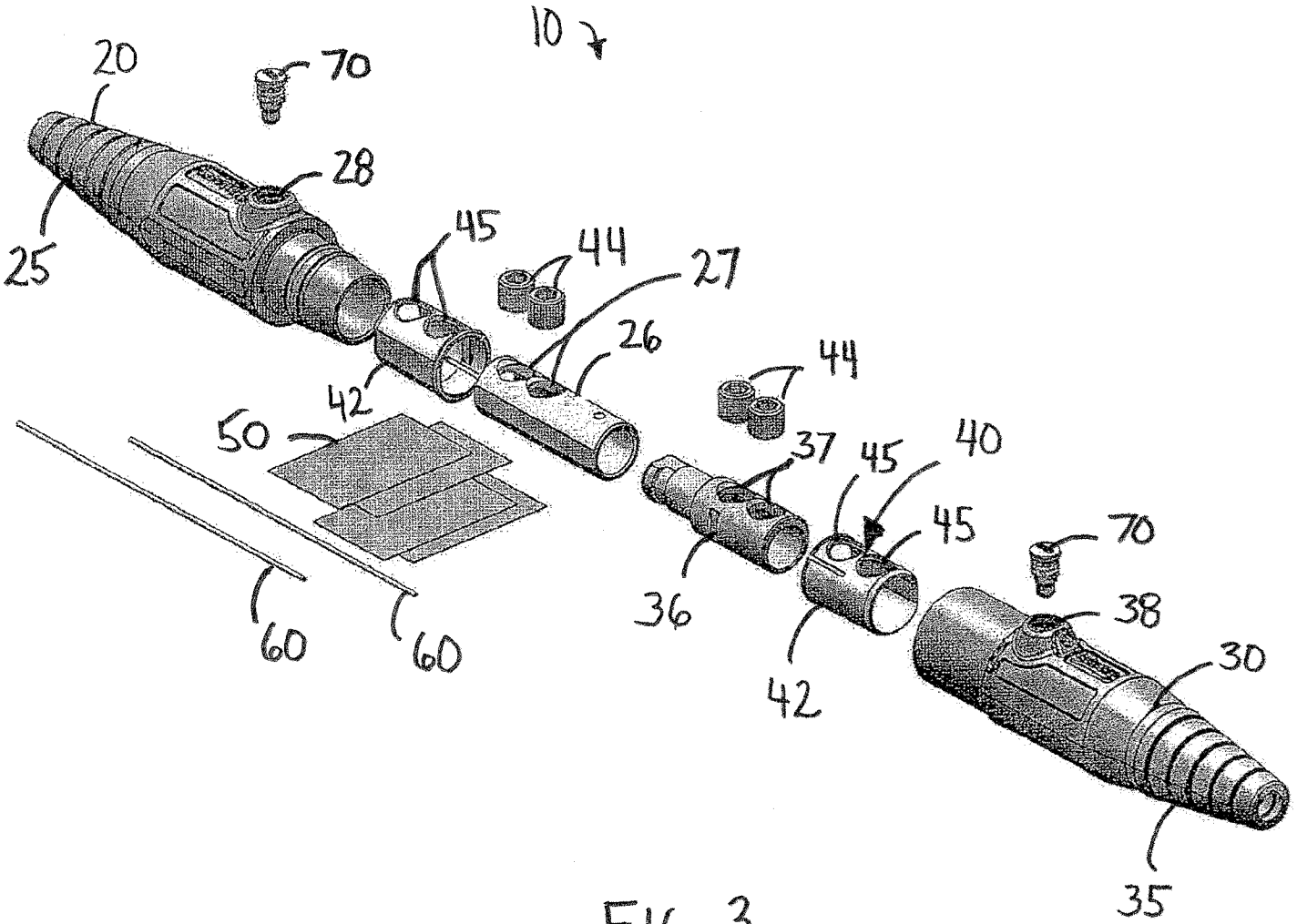
FIG. 3 is an exploded perspective view of the portable power connector of FIG. 1.

As shown in FIGS. 2 and 3, the connector 10 includes a female connector 20 at the first end 12 and a male connector 30 at the second end 14 wherein both the female connector 20 and the male connector 30 extend from the respective first end 12 and second end 14 toward midsection 16. In one embodiment the female and male connectors 20 and 30 comprise insulated tapered connectors, as further described herein below, such as for example, connectors for use with 2 AWG Type W Portable Power Cable through 4/0 AWG Type W Portable Power Cable. The female and male connectors 20 and 30 are installed on, and are in electrical communication with, a power source such as a cable used for power distribution. In addition, each of the female and male connectors 20 and 30 are installed on the cable 11 such that the female connector 20 of a first power cable used for power distribution receives, engages, and provides electrical communication with the male connector 30 of a second power cable used for power distribution. Female connector 20 defines a taper 25 extending radially outwardly from a first portion 22, axially inward toward the midsection 16 of the connector 10, to a second portion 24. Male connector 30 defines a taper 35 extending radially outwardly from a first portion 32, axially inward toward the midsection 16 of the connector 10, to a second portion 34.

The connector 10 includes a female contact 26 and a male contact 36. In one embodiment, the female and male contacts 26 and 36 comprise double set screw contacts such that two set screws are used to engage and secure the female and male contacts 26 and 36 with exposed wire or strands of the cable 11 and assure electrical communication therewith. As described above with respect to the female and male connectors 20 and 30, the components described herein that comprise the connectors 20 and 30 also are for use with 2 AWG Type W Portable Power Cable through 4/0 AWG Type W Portable Power Cable. Typically, only single set screw components are used in connectors for 2 AWG Type W Portable Power Cable through 2/0 AWG Type W Portable Power Cable. As further described below and illustrated in the figures, the connectors 20 and 30 comprise double set screw components particularly defining characteristics for use with 2 AWG Type W Portable Power Cable through 2/0 AWG Type W Portable Power Cable as well as 3/0 AWG Type W Portable Power Cable through 4/0 AWG Type W Portable Power Cable.

The connector 10 further includes one or more spacers 40, such as for example contact spacers 42. In one embodiment, contact spacers 42 comprise double set screw contact spacers. One or more of set screws 44 are received within apertures 45 of one of the contact spacers 42 and corresponding apertures 27 in female contact 26 to provide proper alignment of the female contact 26 within the contact spacer 42. Similarly, one or more of set screws 44 are received within apertures 45 of one of the contact spacers 42 and corresponding apertures 37 in male contact 36 to provide proper alignment of the male contact 36 within the contact spacer 42. In one embodiment, the set screws 44 threadedly engage the apertures 27 in female contact 26 and the apertures 37 in male contact 36 to engage and secure the female and male contacts 26 and 36 with exposed wire or strands of the cable 11 and assure electrical communication therewith.

In one embodiment of the connector 10, the exposed wire or strands of the cable 11 are wrapped with a contact foil 50, such as for example a copper foil. The wrapped strands of the cable 11 are inserted into the female and male contacts 26 and 36 as further described below. The set screws 44 threadedly engage the apertures 27 in female contact 26 and the apertures 37 in male contact 36 to engage and secure the female and male contacts 26 and 36 with the wrapped wire or strands of the cable 11 and assure electrical communication therewith. In one embodiment, one or more members, wires or rods 60 are installed within the connector 10 to provide for strain relief. A retaining screw 70 is received within a corresponding aperture 28 in female connector 20 to secure the assembly of the female connector 26 therein. Similarly, another retaining screw 70 is received within a corresponding aperture 38 in male connector 30 to secure the assembly of the male connector 36 therein. Preferably, retaining screws 70 define an externally threaded portion defined to engage an internally threaded portion defined in each of the apertures 28 and 38 respectfully defined in the female and male connectors 20 and 30.

Figure 4:
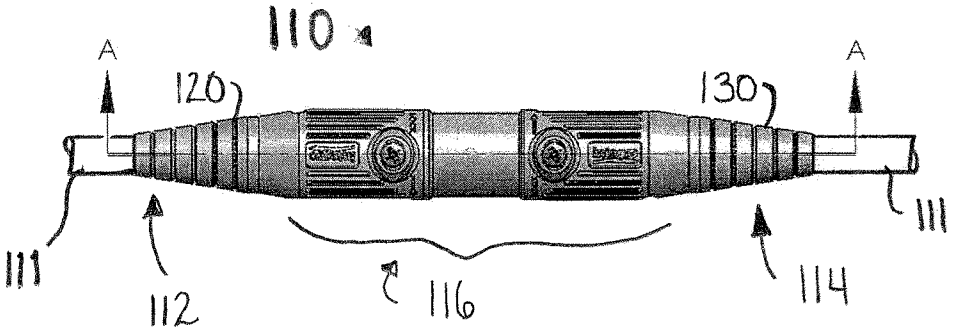
FIG. 4 is a top view of another embodiment of a portable power connector of the present invention.

Another embodiment of a portable power connector 110 is depicted in FIG. 4 and is similar to the portable power connector 10 shown in FIG. 1, thus like elements are given a like element number preceded by the numeral 1.

As shown in FIG. 4, connector 110 is configured for coupling with a power cable 111 to provide an electrical connection between and among multiple power cables. The connector 110 defines a first end 112, a second end 114, and a midsection 116. A cross-section of the connector 110 taken along line A-A of FIG. 4 is provided in FIG. 5, and an exploded perspective view of the connector 110 is provided in FIG. 6.

Figure 5:
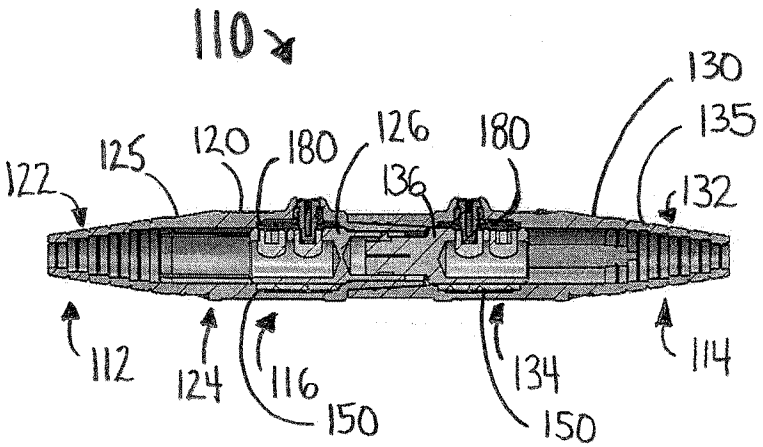
FIG. 5 is a cross-section view of the portable power connector of FIG. 4 taken along line A-A of FIG. 4.
Figure 6:
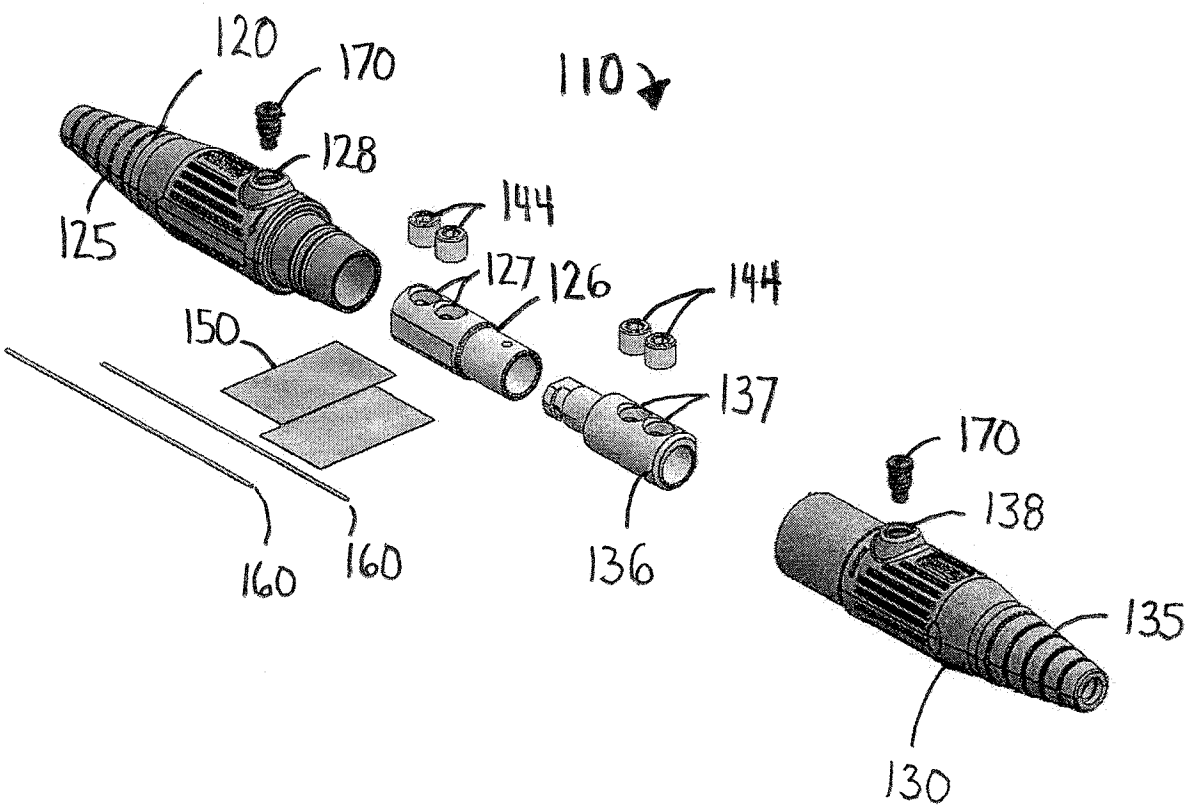
FIG. 6 is an exploded perspective view of the portable power connector of FIG. 4.

As shown in FIGS. 5 and 6, the connector 110 includes a female connector 120 at the first end 112 and a male connector 130 at the second end 114 wherein both the female connector 120 and the male connector 130 extend from the respective first end 112 and second end 114 toward midsection 116. In one embodiment the female and male connectors 120 and 130 comprise insulated tapered connectors. Female connector 120 defines a taper 125 extending radially outwardly from a first portion 122, axially inward toward the midsection 116 of the connector 110, to a second portion 124. Male connector 130 defines a taper 135 extending radially outwardly from a first portion 132, axially inward toward the midsection 116 of the connector 110, to a second portion 134.

The connector 110 includes a female contact 126 and a male contact 136. In one embodiment, the female and male contacts 126 and 136 comprise double set screw contacts. The connector 110 further includes one or more crush rings 180 (FIG. 5). In one embodiment of the connector 110, the exposed wire or strands of the cable 111 are wrapped with a contact foil 150, such as for example a copper foil. One or more members, wires or rods 160 are installed within the connector 110 to provide for strain relief. A retaining screw 170 is received within a corresponding aperture 128 in female connector 120 to secure the assembly of the female connector 126 therein. Similarly, another retaining screw 170 is received within a corresponding aperture 138 in male connector 130 to secure the assembly of the male connector 136 therein. Preferably, retaining screws 170 define an externally threaded portion defined to engage an internally threaded portion defined in each of the apertures 128 and 138 respectfully defined in the female and male connectors 120 and 130.

Figure 7:
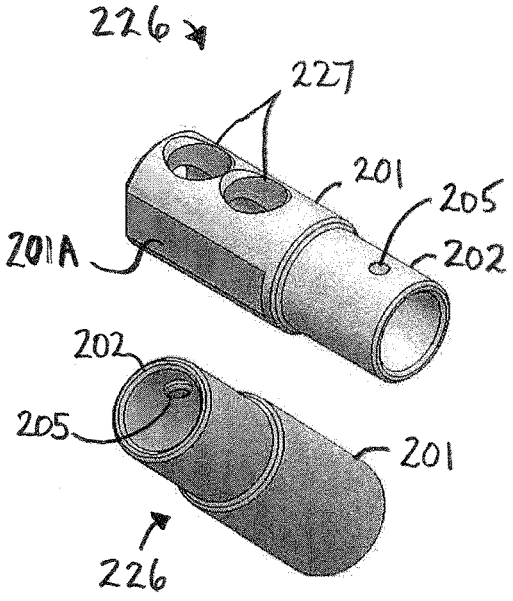
FIG. 7 provides a front and rear perspective view of a female contact for use with the portable power connector of FIG. 1 or FIG. 4.
Figure 8:
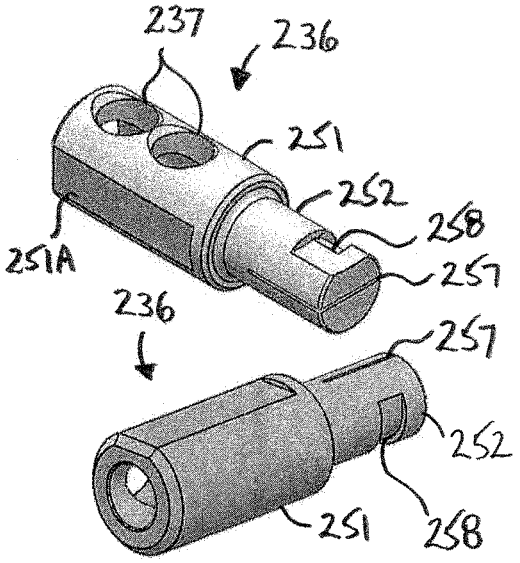
FIG. 8 provides a front and rear perspective view of a male contact for use with the portable power connector of FIG. 1 or FIG. 4.

One embodiment of a female contact 226 according to the present invention is depicted in FIG. 7, and one embodiment of a male contact 236 according to the present invention is depicted in FIG. 8.

Figure 9B:
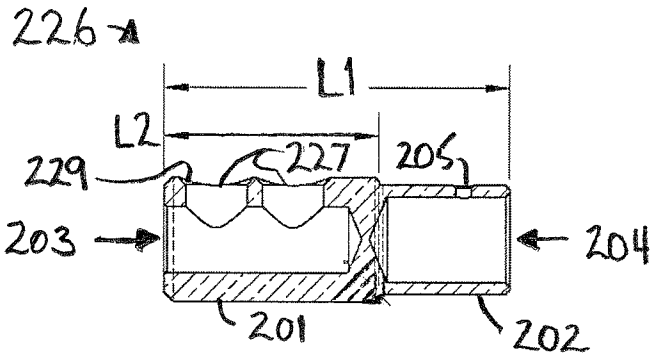
FIG. 9B is a cross-section view of the female contact of FIG. 9A taken along line A-A of FIG. 9A.
Figure 9A:
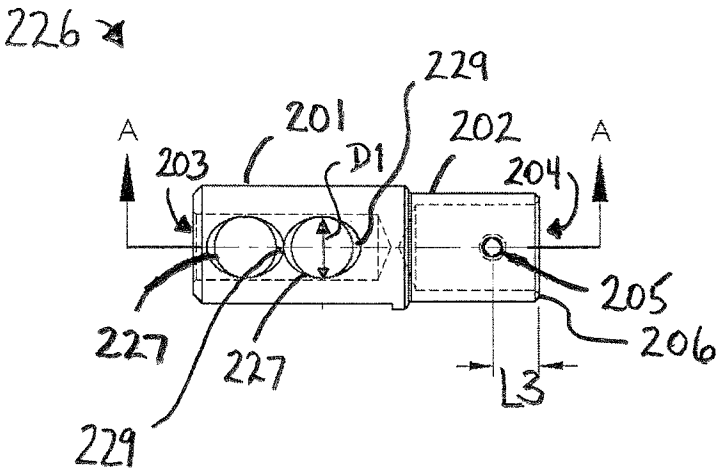
FIG. 9A is top schematic view of one embodiment of the female contact of FIG. 7.

As shown in FIGS. 7 and 9A-9B, one embodiment of the female contact 226 defines a first portion 201 and a second portion 202 and comprises a double set screw contact and is installed on, and is in electrical communication with, a power cable for electrical power distribution. The female contact 226 is selectively installed on 2 AWG Type W Portable Power Cable through 2/0 AWG Type W Portable Power Cable. The female contact 226 includes two (2) radial apertures 227 therein for receiving set screws, such as for example set screw 44 (not shown). The radial apertures 227 define an inner diameter "D1" and a chamfer 229 leading therein. Preferably, the chamfer 229 does not extend circumferentially around the aperture 227; and instead extends along axial portions of the aperture 227 as shown in FIGS. 9A and 9B. Preferably, the inner diameter D1 of the radial apertures 227 is in the range of about 0.375 inch to about 0.625 inch, and more particularly in the range of about 0.5 inch. The female contact 226 defines an overall length "L1", and the first portion 201 of the female contact 226 defines a length "L2". Preferably, L1 is in the range of about 2.5 inches to about 3 inches, and more particularly in the range of about 2.625 inches to about 2.875 inches. In one embodiment, L1 is in the range of about 2.81 inches. Preferably, L2 is in the range of about 1.5 inches to about 2 inches, and more particularly in the range of about 1.625 inches to about 1.875 inches. In one embodiment, L1 is in the range of about 1.75 inches.

As further shown in FIGS. 9A and 9B, the first portion 201 defines a bore 203 extending axially partway therethrough and preferably extending axially beyond the two (2) radial apertures 227 therein. The second portion 202 defines a bore 204 extending axially partway therethrough and preferably extending axially beyond a radial aperture 205 therein. The center of the radial aperture 205 extending through the second portion 202 is located in a distance "L3" from an exposed end face 206 of the second portion 202. Preferably, L3 is in the range of about 0.25 inch to about 0.5 inch, and more particularly in the range of about 0.375 inch.

Figures 9C, 9D, 9E:
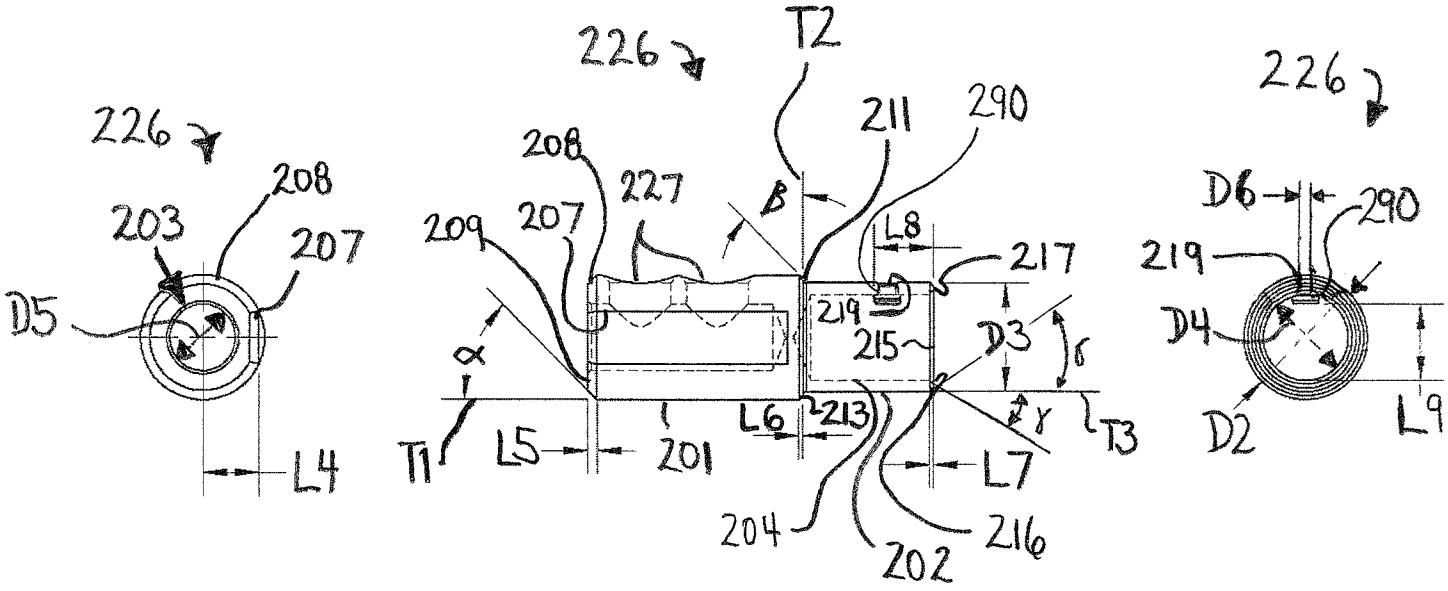
FIG. 9C is a schematic view of one end of the female contact of FIG. 9A.
FIG. 9D is side schematic view of the female contact of FIG. 9A.
FIG. 9E is a schematic view of another end of the female contact of FIG. 9A.
Figure 1D:
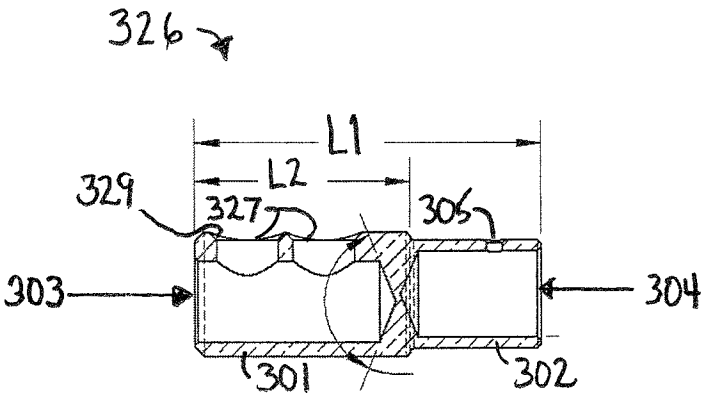
Figure 1D:
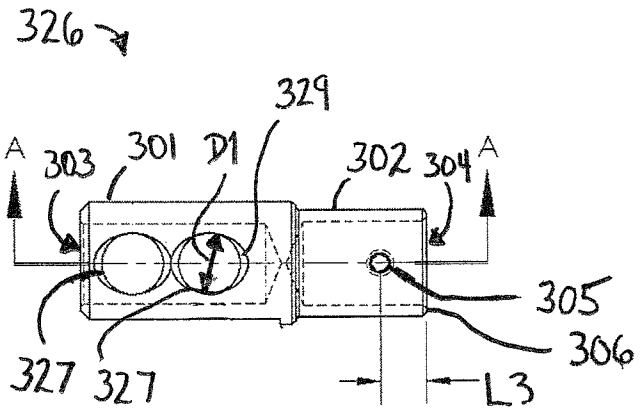
Figure 1D:
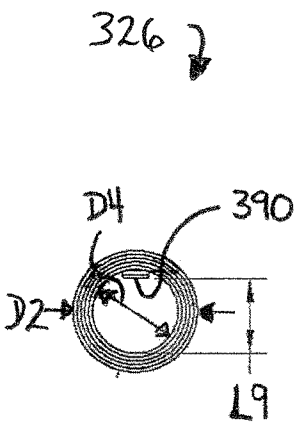
Figure 1D:
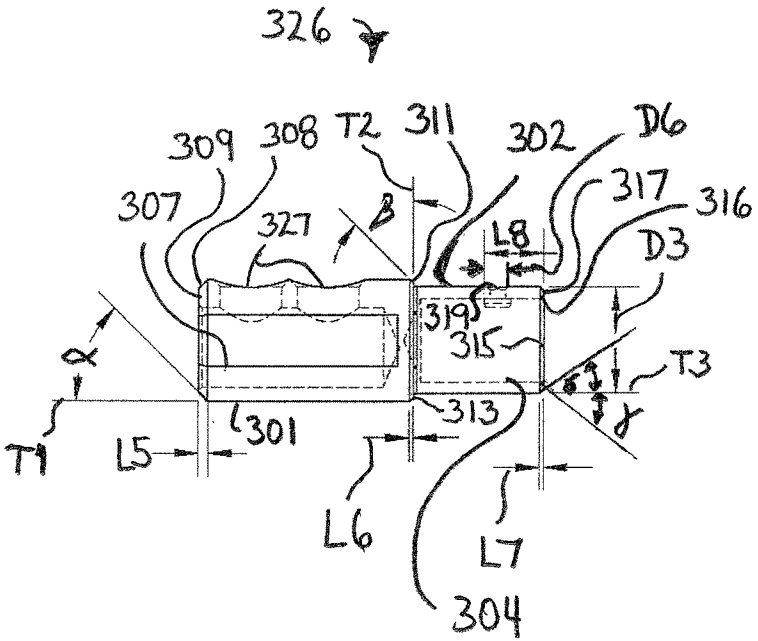
Figure 1D:
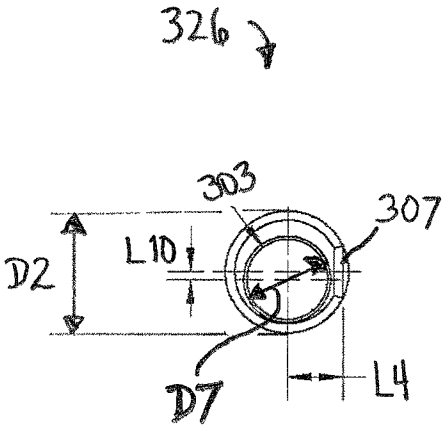

As further shown in FIGS. 9C-9E, the first portion 201 of the female contact 226 defines an outer diameter "D2". Preferably, the outer diameter D2 of the first portion 201 is in the range of about 0.875 inch to about 1.125 inches, and more particularly in the range of about 1 inch. The second portion 202 of the female contact 226 defines an outer diameter "D3" and the bore 204 of the second portion 202 defines an inner diameter "D4". The bore 203 of the first portion 201 defines an inner diameter "D5". Preferably, the outer diameter D3 of the second portion 202 is in the range of about 0.5 inch to about 1 inch, and more particularly in the range of about 0.625 inch to about 0.875 inch. Preferably, the inner diameter D4 of the bore 204 of the second portion 202 is in the range of about 0.625 inch to about 0.875 inch. In one embodiment, D4 is in the range of about 0.688 inch. Preferably, the inner diameter D5 of the bore 203 of the first portion 201 is in the range of about 0.375 inch to about 0.625 inch. In one embodiment, D5 is in the range of about 0.53 to about 0.58 inch. The outer diameter D2 of the first portion 201 of the female contact 226 defines a flat portion or a flat 207, the outer surface of which defines a distance L4 from the center of the bore 203. Preferably, L4 is in the range of about 0.375 inch to about 0.5 inch, and more particularly in the range of about 0.45 inch.

In one embodiment, a first end face 209 of the first portion 201 of the female contact 226 defines a chamfer 208 having a length "L5" and defining an angle alpha (α) with a line "T1" tangent to the outer diameter D2 of the first portion 201. A second end face 213 of the first portion 201 of the female contact 226 that transitions to the second portion 202 of the female contact 226 defines a chamfer 211 having a length "L6" and defining an angle beta (β) with a line "T2" perpendicular to the outer diameter D2 of the first portion 201. An end face 217 of the second portion 202 of the female contact 226 defines an outer chamfer 215 having a length "L7" and defining an angle gamma (γ) with a line "T3" tangent to the outer diameter D3 of the second portion 202. The end face 217 also defines an inner chamfer 216 having the length L7 and defining an angle delta (δ) with the line T3. Preferably, L5 is in the range of about 0.05 inch to about 0.1 inch, and more particularly in the range of about 0.075 inch. Preferably, L6 and L7 are in the range of about 0.025 inch to about 0.05 inch, and more particularly in the range of about 0.03 inch. Preferably, angles alpha (α), beta (β), gamma (γ) and delta (δ) are in the range of about 0° to about 90°, and more particularly in the range of about 45°.

As further shown in FIG. 9E, a cam pin 290 is installed within an aperture 219 defined in the second portion 202 of the female contact 226. The aperture 219 defined in the second portion 202 defines a diameter "D6". The cam pin 290 extends as far as a distance "L8" axially inwardly into the bore 204 of the second portion 202 from the end face 217, and provides a clearance distance "L9" to the inner diameter D4 of the bore 204. Preferably, the diameter D6 is in the range of up to about 0.25 inch, and more particularly in the range of about 0.125 inch. Preferably, L8 is in the range of about 0.375 inch to about 0.5 inch, and more particularly in the range of about 0.484 inch. Preferably, L9 is in the range of about 0.5 inch to about 0.75 inch, and more particularly in the range of about 0.625 inch or in the range of about 0.612 inch.

Another embodiment of a female contact 326 is depicted in FIG. 10A and is similar to the female contact 226 depicted in FIG. 9A, thus like elements are given a like element number preceded by the numeral 3.

As shown in FIGS. 10A-10E, one embodiment of the female contact 326 defines a first portion 301 and a second portion 302 and comprises a double set screw contact and is installed on, and is in electrical communication with, a power cable for electrical power distribution. The female contact 326 is selectively installed on 2/0 AWG Type W Portable Power Cable through 4/0 AWG Type W Portable Power Cable. The female contact 326 includes two (2) radial apertures 327 therein for receiving set screws, such as for example set screw 44 (not shown). The radial apertures 327 also define the inner diameter D1 and a chamfer 329 leading therein. Preferably, the chamfer 329 does not extend circumferentially around the aperture 327; and instead extends along axial portions of the aperture 327 as shown in FIGS. 10A and 10B. The female contact 326 also defines the overall length L1, and the first portion 301 of the female contact 326 also defines the length L2.

As further shown in FIGS. 10A and 10B, the first portion 301 defines a bore 303 extending axially partway therethrough and preferably extending axially beyond the two (2) radial apertures 327 therein. The second portion 302 defines a bore 304 extending axially partway therethrough and preferably extending axially beyond a radial aperture 305 therein. The center of the radial aperture 305 extending through the second portion 302 also is located the distance L3 from an exposed end face 306 of the second portion 302.

As further shown in FIGS. 10C-10E, the first portion 301 of the female contact 326 also defines the outer diameter D2. The second portion 302 of the female contact 326 also defines the outer diameter D3 and the bore 304 of the second portion 302 also defines the inner diameter D4. The bore 303 of the first portion 301 defines an inner diameter "D7". Preferably, the inner diameter D7 of the bore 303 of the first portion 301 is in the range of about 0.5 inch to about 0.875 inch, and more particularly in the range of about 0.625 inch to about 0.75 inch. In one embodiment, D7 is in the range of about 0.656 inch to about 0.71 inch. The outer diameter D2 of the first portion 301 of the female contact 326 defines a flat portion or a flat 307, the outer surface of which also defines the distance L4 from the center of the bore 303.

In one embodiment, a first end face 309 of the first portion 301 of the female contact 326 defines a chamfer 308 also having the length L5 and also defining the angle alpha (α) with the tangent line T1. A second end face 313 of the first portion 301 of the female contact 326 that transitions to the second portion 302 of the female contact 326 defines a chamfer 311 also having the length L6 and also defining an angle beta (β) with the perpendicular line T2. An end face 317 of the second portion 302 of the female contact 326 defines an outer chamfer 315 also having the length L7 and also defining the angle gamma (γ) with the tangent line T3. The end face 317 also defines an inner chamfer 316 having the length L7 and defining the angle delta (δ) with the line T3.

As further shown in FIG. 10E, a cam pin 390 is installed within an aperture 319 defined in the second portion 302 of the female contact 326. The aperture 319 defined in the second portion 302 also defines the diameter D6. Again, the cam pin 390 extends as far as the distance L8 axially inwardly into the bore 304 of the second portion 302 from the end face 317, and also provides the clearance distance L9 to the inner diameter D4 of the bore 304.

As shown in FIGS. 10C and 10D, in one embodiment of the female contact 326, the inner diameter D7 of the bore 303 of the first portion 301 of the female contact 326 is offset from the outer diameter D2 of the first portion 301. In one embodiment, the center of the inner diameter D7 of the bore 303 is offset from the center of the outer diameter D2 of the first portion 301 by a distance "L10". Preferably, L10 is in the range of up to about 0.125 inch, and more particularly in the range of up to about 0.075 inch. In one embodiment, the offset distance L10 is in the range of about 0.06 inch.

Figure 11B:
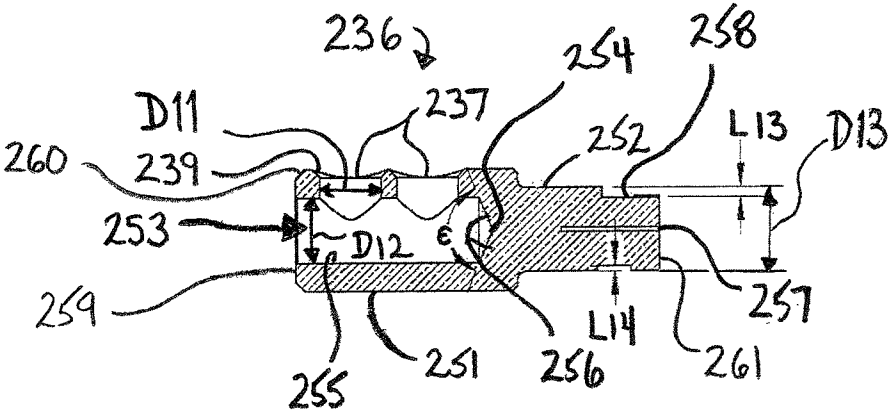
FIG. 11B is a cross-section view of the male contact of FIG. 11A taken along line A-A of FIG. 11A.
Figure 11A:
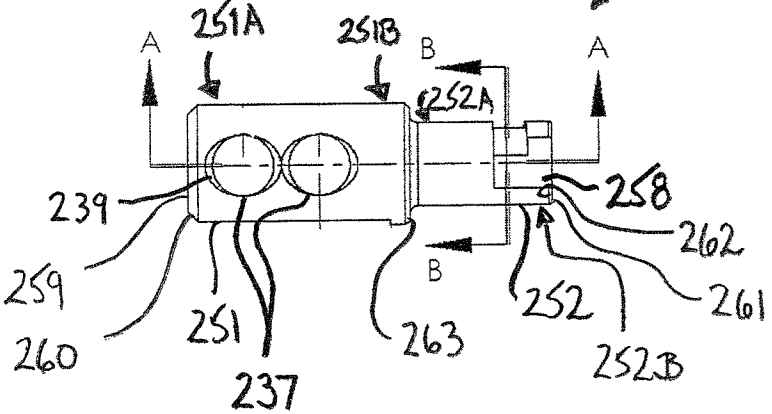
FIG. 11A is top schematic view of one embodiment of the male contact of FIG. 8.

As shown in FIGS. 8 and 11A-11C, one embodiment of the male contact 236 defines a first portion 251 and a second portion 252 and comprises a double set screw contact and is installed on, and is in electrical communication with, a power cable for electrical power distribution. The male contact 236 is selectively installed on 2 AWG Type W Portable Power Cable through 2/0 AWG Type W Portable Power Cable. The first portion 251 of the male contact 236 defines a first end 251A and a second end 251B; and the second portion 252 of the male contact 236 defines a first end 252A and a second end 252B. The first end 251A of the first portion 251 defines a first end face 259 having a chamfer 260; and the second end 251B defines a chamfer 263 that transitions to the first end 252 A of the second portion 252. The second end 252B of the second portion 252 defines a second end face 261 having a chamfer 262. The male contact 236 includes two (2) radial apertures 237 therein for receiving set screws, such as for example set screw 44 (not shown). The radial apertures 237 define an inner diameter "D11" and a chamfer 239 leading therein. Preferably, the chamfer 239 does not extend circumferentially around the aperture 237; and instead extends along axial portions of the aperture 237 as shown in FIGS. 11A and 11B. Preferably, the inner diameter D11 of the radial apertures 237 is in the range of about 0.375 inch to about 0.625 inch, and more particularly in the range of about 0.5 inch.

Figure 11C:
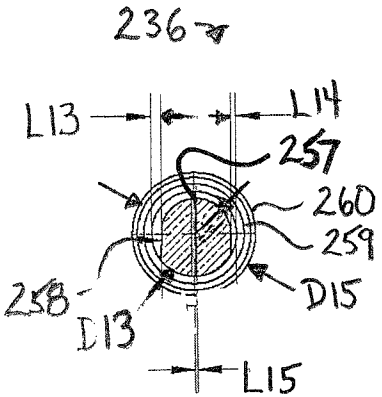
FIG. 11C is a cross-section view of the male contact of FIG. 11A taken along line B-B of FIG. 11A.

As further shown in FIGS. 11A-11C, the first portion 251 defines an outer diameter "D15" and a bore 253 extending axially partway therethrough and preferably extending axially beyond the two (2) radial apertures 237 therein. Preferably, the outer diameter D15 of the first portion 251 is in the range of about 0.875 inch to about 1.125 inches, and more particularly in the range of about 1 inch. The bore 253 defines an inner surface 255 having an inner diameter "D12" and preferably terminates in a taper 256 extending radially inwardly from an end of the inner surface 255 to a point 254 wherein such taper 256 defines an angle epsilon (ε) in the range of about 120° to about 150°, and more particularly in the range of about 135°. Preferably, the inner diameter D12 of the bore 253 of the first portion 251 is in the range of about 0.375 inch to about 0.75 inch, and more particularly in the range of about 0.5 inch to about 0.625 inch. In one embodiment, the inner diameter D12 of the bore 253 is in the range of about 0.53 inch to about 0.56 inch.

In one embodiment, the second portion 252 defines a cam groove 258 having a maximum depth "L13" and a minimum depth "L14" as measured from an outer diameter "D13" of the second portion 252. Preferably, L13 is in the range of about 0.075 inch to about 0.1 inch, and more particularly in the range of about 0.08 inch to about 0.085 inch. Preferably, L14 is in the range of about 0.025 inch to about 0.05 inch, and more particularly in the range of about 0.04 inch to about 0.045 inch. The cam groove 258 also defines a slot 257 located at the center of the cam groove 258, extending axially partway therethrough, and defining a width "L15". Preferably, L15 is in the range of up to about 0.025 inch, and more particularly in the range of up to about 0.015 inch.

Figure 11F:
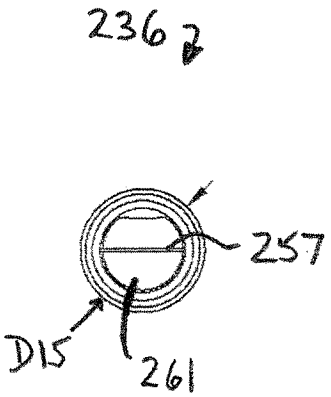
FIG. 11F is a schematic view of another end of the male contact of FIG. 11A.
Figure 11E:
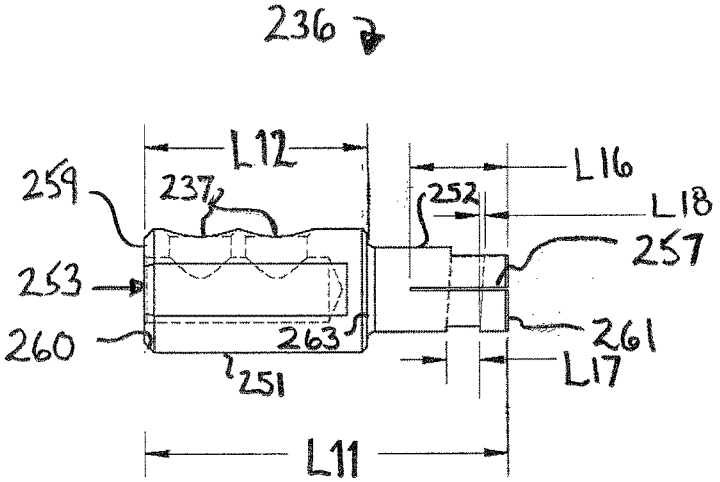
FIG. 11E is a side schematic view of the male contact of FIG. 11A.
Figure 11D:
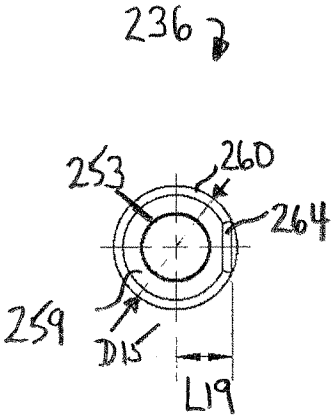
FIG. 11D is a schematic view of one end of the male contact of FIG. 11A.

As shown in FIGS. 11D-11F, the male contact 236 defines an over length "L11" (FIG. 10E), and the first portion 251 of the male contact 236 defines a length "L12". The slot 257 located at the center of the cam groove 258 extends axially inwardly from the second end face 261 of the second portion 252 a length "L16". The cam groove 258 extends axially a length "L17", and circumferentially around the second portion 252 while defining a cam advance distance "L18". Preferably, L11 is in the range of about 2.75 inches to about 3.25 inches, and more particularly in the range of about 2.875 inches to about 3.125 inches. In one embodiment, L11 is in the range of about 3.0 inches. Preferably, L12 is in the range of about 1.5 inches to about 2 inches, and more particularly in the range of about 1.625 inches to about 1.875 inches. In one embodiment, L12 is in the range of about 1.8 inches. Preferably, L16 is in the range of about 0.625 inch to about 0.875 inch, and more particularly in the range of about 0.75 inch to about 0.80 inch. Preferably, L17 is in the range of about 0.125 inch to about 0.375 inch, and more particularly in the range of about 0.25 inch to about 0.30 inch. Preferably, the cam advance L18 is in the range of about 0.05 inch, and more particularly in the range of about 0.4 inch. As further shown in FIG. 11D, in one embodiment, the outer diameter D15 of the first portion 251 of the male contact 236 defines a flat portion or a flat 264, the outer surface of which defines a distance L19 from the center of the bore 253. Preferably, L19 is in the range of about 0.375 inch to about 0.5 inch, and more particularly in the range of about 0.45 inch.

Figure 12B:
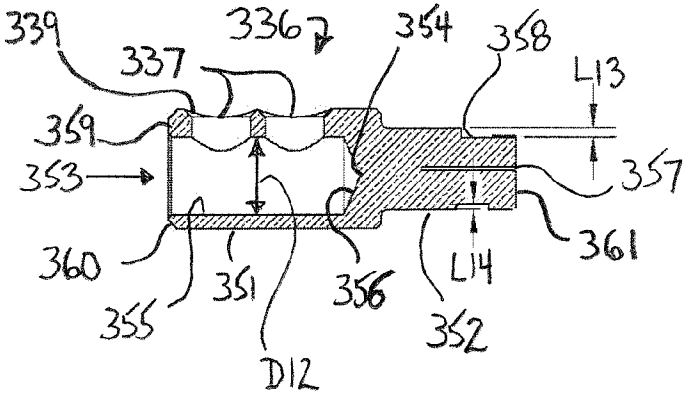
FIG. 12B is a cross-section view of the male contact of FIG. 12A taken along line A-A of FIG. 12A.
Figure 12A:
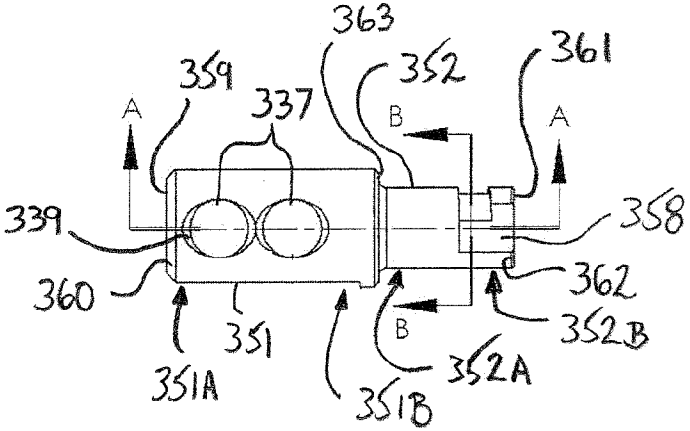
FIG. 12A is top schematic view of another embodiment of the male contact of FIG. 8.

Another embodiment of a male contact 336 is depicted in FIG. 12A and is similar to the male contact 236 depicted in FIG. 11A, thus like elements are given a like element number preceded by the numeral 3.

As shown in FIGS. 12A-12F, one embodiment of the male contact 326 defines a first portion 351 and a second portion 352 and comprises a double set screw contact and is installed on, and is in electrical communication with, a power cable for electrical power distribution. The male contact 326 is selectively installed on 2/0 AWG Type W Portable Power Cable through 4/0 AWG Type W Portable Power Cable. The male contact 336 defines a first portion 351 and a second portion 352 and comprises a double set screw contact preferably selectively installed on 2/0 AWG Type W Portable Power Cable through 4/0 AWG Type W Portable Power Cable. The first portion 351 of the male contact 336 defines a first end 351A and a second end 351B; and the second portion 352 of the male contact 336 defines a first end 352A and a second end 352B. The first end 351A of the first portion 351 defines a first end face 359 having a chamfer 360; and the second end 351B defines a chamfer 363 that transitions to the first end 352 A of the second portion 352. The second end 352B of the second portion 352 defines a second end face 361 having a chamfer 362. The male contact 336 includes two (2) radial apertures 337 therein for receiving set screws, such as for example set screw 44 (not shown). The radial apertures 337 define the inner diameter D11 and a chamfer 339 leading therein. Preferably, the chamfer 339 does not extend circumferentially around the aperture 337; and instead extends along axial portions of the aperture 337 as shown in FIGS. 12A and 12B.

Figure 12C:
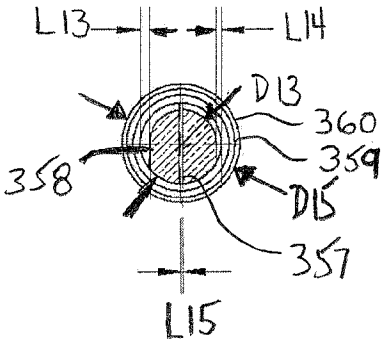
FIG. 12C is a cross-section view of the male contact of FIG. 12A taken along line B-B of FIG. 12A.

As further shown in FIGS. 12A-12C, the first portion 351 defines the outer diameter D15 and a bore 353 extending axially partway therethrough and preferably extending axially beyond the two (2) radial apertures 337 therein. The bore 353 defines an inner surface 355 having the inner diameter D12 and preferably terminates in a taper 356 extending radially inwardly from an end of the inner surface 355 to a point 354. In one embodiment, the second portion 352 defines a cam groove 358 having the maximum depth L13 and the minimum depth L14 as measured from the outer diameter D13 of the second portion 352. The cam groove 358 defines a slot 357 located at the center of the cam groove 358, extending axially partway therethrough, and defining the width L15.

Figure 12F:
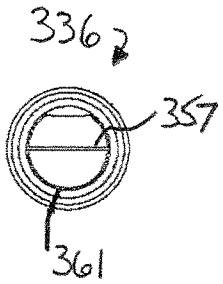
FIG. 12F is a schematic view of another end of the male contact of FIG. 12A.
Figure 12E:
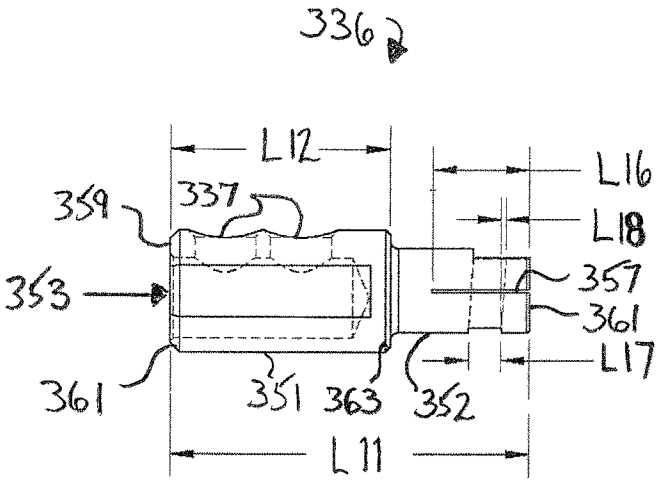
FIG. 12E is a side schematic view of the male contact of FIG. 12A.
Figure 12D:
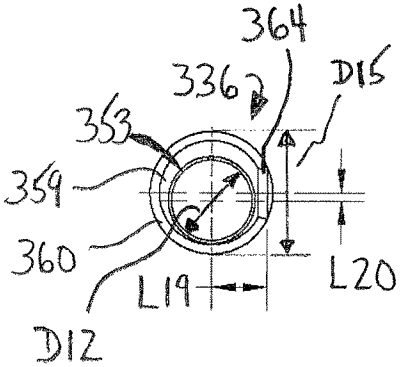
FIG. 12D is a schematic view of one end of the male contact of FIG. 12A.

As shown in FIGS. 12D-12F, the male contact 336 defines the over length L11, and the first portion 351 of the male contact 336 defines the length L12. The slot 357 located at the center of the cam groove 358 extends axially inwardly from the second end face 361 of the second portion 352 the length L16. The cam groove 358 extends axially the length L17, and circumferentially around the second portion 352 while defining the cam advance distance L18. As further shown in FIG. 12D, in one embodiment, the outer diameter D15 of the first portion 351 of the male contact 336 defines a flat portion or a flat 364, the outer surface of which defines the distance L19 from the center of the bore 353.

As shown in FIGS. 12D and 12E, in one embodiment of the male contact 336, the inner diameter D12 of the bore 353 of the first portion 351 of the male contact 336 is offset from the outer diameter D15 of the first portion 351. In one embodiment, the center of the inner diameter D12 of the bore 353 is offset from the center of the outer diameter D15 of the first portion 351 by a distance "L20". Preferably, L20 is in the range of up to about 0.125 inch, and more particularly in the range of up to about 0.075 inch. In one embodiment, the offset distance L20 is in the range of about 0.06 inch.

Each of the female contacts 226, 326 and male contacts 236, 336 are installed on a respective end of the cable used for power distribution such that the female contact 226, 326 of a first power cable receives, engages, and provides electrical communication with the male contact 236, 336 of a second power cable. As shown in FIGS. 7 and 8, the female and male contacts, for example the female and male contacts 226, 236, respectively define a flat portion or a flat 201A and 251A to provide for ease of alignment during installation. Female contacts 226, 326 and male contacts 236, 336 may be fabricated from any suitably electrically conductible material such as for example metal, and more particularly a brass alloy. The female contacts 226, 326 and male contacts 236, 336 are smaller in size than conventional contacts and thus comprise substantially less material. The reduced contact size and lower, more efficient use of fabrication material provides for a lower cost and lighter weight contact with less manufacturing waste, and without sacrificing ruggedness and performance. Moreover, the female contacts 226, 326 and male contacts 236, 336 are self-aligning, both rotationally and axially, therefore there is no longer a need for twisting and sliding such contacts during assembly to align the retaining screw retaining screw 70, 170.

Figure 13B:
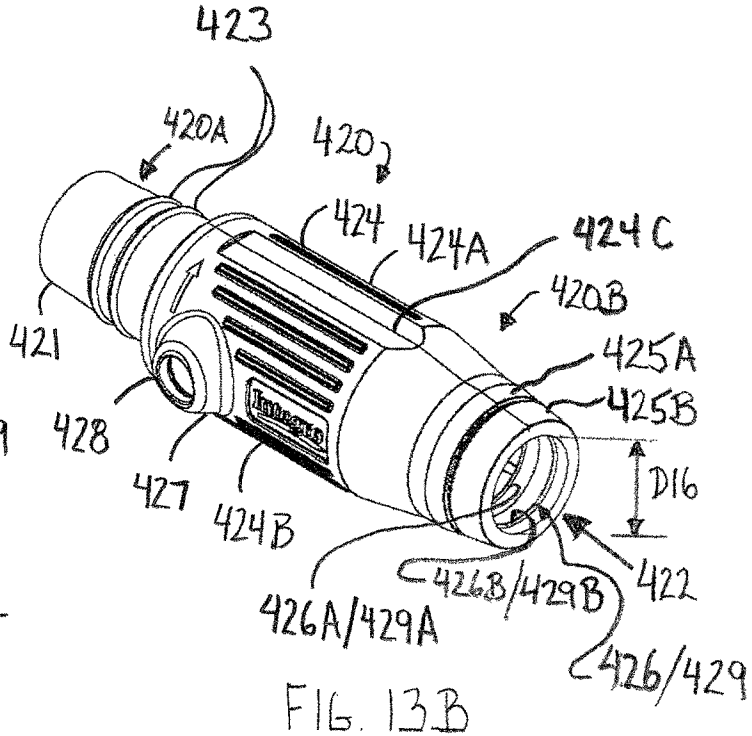
FIG. 13B is a perspective view the female insulator of FIG. 13A having a truncated taper.
Figure 13A:
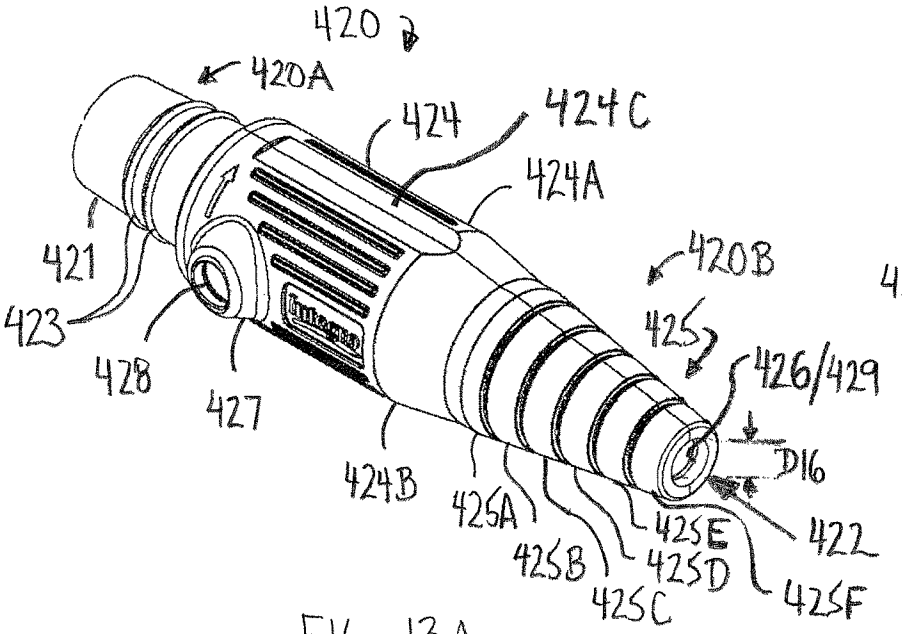
FIG. 13A is a perspective view of one embodiment of a female insulator for use with the portable power connector of FIG. 1 or FIG. 4.

The female connectors 20, 120 of FIGS. 3 and 6 comprise a female tapered insulator 420 as shown in FIGS. 13A and 13B. The insulator 420 defines a first end 420A, a second end 420B, and a bore 422 extending therethrough for receiving the components shown in, and described in reference to, FIGS. 3 and 6. The insulator 420 comprises a housing 424 typically comprised of two segments 424A and 424B such that the insulator 420 can be installed in the field around a power cable and other connector components. A taper 425 is defined at the second end 420B and is divided into tapered segments 425A-425F which respectively define a decreasing inner diameter "D16" such that each of the tapered segments 425A-425F can safely and securely receive, and be installed thereon, one of a standard electrical cable size used to distribute power, for example, Type W Single Conductor Portable Round Power Cable such as 2 AWG Type W Portable Power Cable through 4/0 AWG Type W Portable Power Cable. Preferably, D16 ranges from about 0.25 inch to 1.25 inches, and more particularly from about 0.4 inch to about 1.05 inches.

As further shown in FIGS. 13A and 13B, the first end 420A of the insulator 420 defines a female extension 421 extending axially outward therefrom designed to receive a corresponding male extension of a male tapered insulator as further described below. One embodiment of the housing 424 of the female insulator 420 comprises one or more first O-rings 423 installed on the female extension 421 for increased water ingress protection, particularly at the point of connection of the female extension 421 and the corresponding male extension of the male tapered insulator as further described below. In one embodiment, the first O-rings 423 are integrally formed or molded with the female insulator 420 defines an interference fit at the point of connection of the female extension 421 and the corresponding male extension of the male tapered insulator.

In one embodiment, the insulator 420 defines tapered segments 425A-425F selectively sized to respectively safely and securely receive, and be installed thereon, appropriately sized standard electrical cable to distribute various rated power. For example, the respective tapered segments 425A-425F can be sized as follows: (i) 425A: 0.99-1.02 inches; (ii)

425B: 0.92-0.99 inch; (iii) 425C: 0.82-0.92 inch; (iv) 425D: 0.72-0.82 inch; (v) 425E: 0.62-0.72 inch; and (vii) 425F: 0.46-0.62 inch. The taper 425 of the insulator 420 can be can be truncated at one of the tapered segments 425A-425F to safely and securely receive, and be installed thereon, a particularly sized standard electrical cable. In one embodiment and as shown in FIG. 13B, the taper 425 of the insulator 420 is truncated at tapered segment 425B to safely and securely receive, and be installed thereon, a standard 4/0 AWG Type W Portable Power Cable. One advantage in providing such an embodiment is that the selectively sized insulator 420 eliminates the need to cut and size the insulator 420 in the field. In one embodiment, one or more second O-rings 426 are positioned in a groove 429 defined in the bore 422 at the second end 420B of the insulator 420. In one embodiment, a second O-Ring 426 is positioned in a groove 429 defined in the bore 422 at the second end 420B of the insulator 420 and proximate or between each of the tapered segments 425A-425F. For example, and as further shown in FIG. 13B, a second O-ring 426A is positioned in a groove 429A defined in the bore 422 between the tapered segment 425A and the housing 424; and a second O-ring 426B is positioned in a groove 429B defined in the bore 422 between the tapered segments 425A and 425B.

As described above with respect to the female connectors 20, 120 of FIGS. 3 and 6, the retaining screw 70, 170 is received within the corresponding aperture 28, 128 in the female connector 20, 120 to secure the assembly of the female connector 26,126 therein. As further shown in FIGS. 13A and 13B, the insulator 420 defines a circular mount 127 extending radially outwardly from the housing 424 and defining an aperture 428 therein designed to receive a correspondingly sized and/or threaded retaining screw (not shown) therein. The insulator 420 also defines a flat portion or a flat 424C to provide for ease of alignment during installation.

Figure 14B:
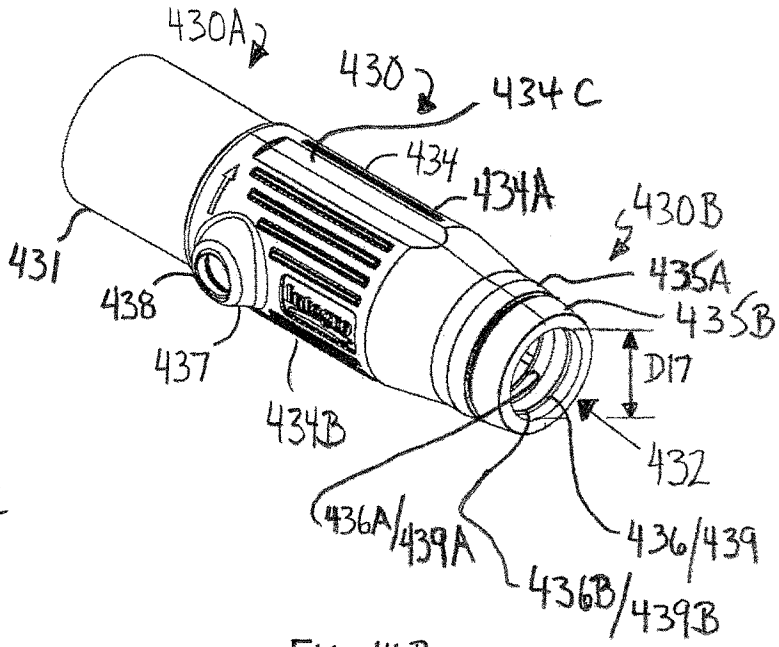
FIG. 14B is a perspective view the male insulator of FIG. 14A having a truncated taper.
Figure 14A:
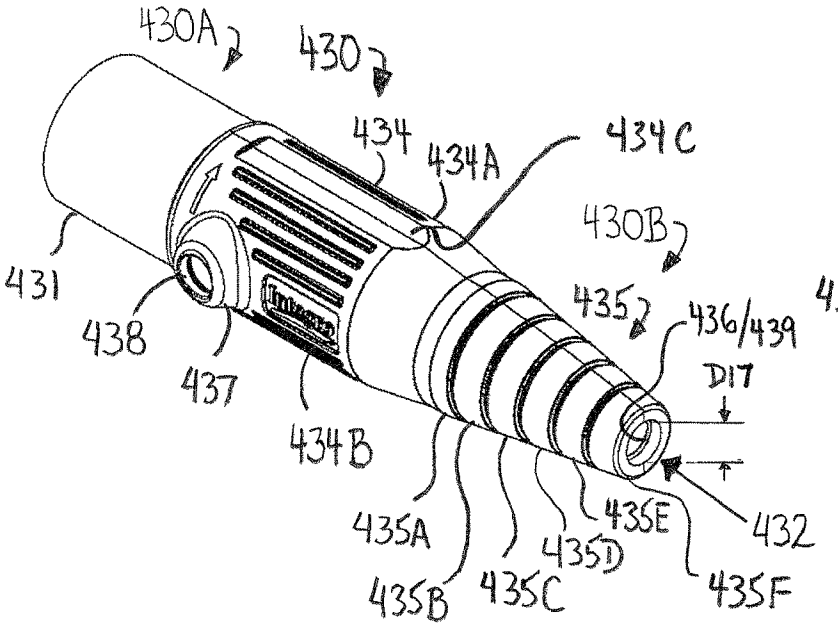
FIG. 14A is a perspective view of one embodiment of a male insulator for use with the portable power connector of FIG. 1 or FIG. 4.

The male connectors 30, 130 of FIGS. 3 and 6 comprise a male tapered insulator 430 as shown in FIGS. 14A and 14B. The insulator 430 defines a first end 430A, a second end 430B, and a bore 432 extending therethrough for receiving the components shown in, and described in reference to, FIGS. 3 and 6. The insulator 430 comprises a housing 434 typically comprised of two segments 434A and 434B such that the insulator 430 can be installed in the field around a power cable and other connector components. A taper 435 is defined at the second end 430B and is divided into tapered portions 435A-435F which respectively define a decreasing inner diameter "D17" such that each of the tapered portions 435A-435F can safely and securely receive, and be installed thereon, one of a standard electrical cable size used to distribute power, for example, Type W Single Conductor Portable Round Power Cable such as 2 AWG Type W Portable Power Cable through 4/0 AWG Type W Portable Power Cable. Preferably, D17 ranges from about 0.25 inch to 1.25 inches, and more particularly from about 0.4 inch to about 1.05 inches.

As further shown in FIGS. 14A and 14B, the first end 430A of the insulator 430 defines a male extension 431 designed to engage and be received within the corresponding female extension 421 of the female tapered insulator 420 as shown in FIGS. 1 and 4. As described above with reference to FIGS. 13A and 13B, one embodiment of the housing 424 of the female insulator 420 comprises one or more first O-rings 423 installed on the female extension 421 for increased water ingress protection, particularly at the point of connection of the female extension 421 with the male extension 431 of the male insulator 430. The first O-rings 423 define an interference fit at the point of connection of the female extension 421 with the male extension 431 to prevent water ingress at the point of connection.

In one embodiment, the insulator 430 defines tapered segments 435A-435F selectively sized to respectively safely and securely receive, and be installed thereon, appropriately sized standard electrical cable to distribute various rated power. For example, the respective tapered segments 435A-435F can be sized as follows: (i) 435A: 0.99-1.02 inches; (ii) 435B: 0.92-0.99 inch; (iii) 435C: 0.82-0.92 inch; (iv) 435D: 0.72-0.82 inch; (v) 435E: 0.62-0.72 inch; and (vii) 435F: 0.46-0.62 inch. The taper 435 of the insulator 430 can be can be truncated at one of the tapered segments 435A-435F to safely and securely receive, and be installed thereon, a particularly sized standard electrical cable. In one embodiment and as shown in FIG. 14B, the taper 435 of the insulator 430 is truncated at tapered segment 435B to safely and securely receive, and be installed thereon, a standard 4/0 AWG Type W Portable Power Cable. One advantage in providing such an embodiment is that the selectively sized insulator 430 eliminates the need to cut and size the insulator 430 in the field. In one embodiment, one or more third O-rings 436 are positioned in a groove 439 defined in the bore 432 at the second end 430B of the insulator 430. In one embodiment, a third O-Ring 436 is positioned in a groove 439 defined in the bore 432 at the second end 430B of the insulator 430 and between each of the tapered segments 435A-435F. For example, and as further shown in FIG. 14B, a third O-ring 436A is positioned in a groove 439A defined in the bore 432 between the tapered segment 435A and the housing 434; and a third O-ring 436B is positioned in a groove 439B defined in the bore 432 between the tapered segments 435A and 435B.

As described above with respect to the male connectors 30, 130 of FIGS. 3 and 6, the retaining screw 70, 170 is received within the corresponding aperture 38, 138 in the male connector 30, 130 to secure the assembly of the male connector 36,136 therein. As further shown in FIGS. 14A and 14B, the insulator 430 defines a circular mount 437 extending radially outwardly from the housing 434 and defining an aperture 438 designed to receive a correspondingly sized and/or threaded retaining screw (not shown) therein. The insulator 430 also defines a flat portion or a flat 434C to provide for ease of alignment during installation.

One advantage of defining the tapered end 420B and 430B, also referred to as the cable end, of the respective female and male insulators 420 and 430 is that the taper 425, 435 reduces snagging on obstacles while deploying cable assemblies in the field. Another embodiment of the tapered end 420B and 430B of the respective female and male insulators 420 and 430 defines V-Notches with clearly marked cable sizes molded therein or suitably marked thereon to accommodate the accurate trimming of the female and male insulators 420 and 430 for a wide range of cable diameters as described above. Preferably, the female and male insulators 420 and 430 comply with United Laboratories ("UL") Enclosure Types 4X, 3R and 12K ratings. One embodiment of the insulated housings 424, 434 of the respective female and male insulators 420 and 430 defines an alignment indicator molded therein or suitably marked thereon to enable more efficient assembly of the connectors 10, 110. Another embodiment of the insulated housings 424, 434 defines a raised wire gauge or strip gauge alignment indicator molded therein or suitably marked thereon to enable more efficient removal of cable insulation. Another embodiment of the insulated housings 424, 434 defines a direction arrow or lock arrow molded therein or suitably marked thereon to indicate a correct locking direction for the secure engagement connection of the female and male contacts 26, 126 and 36, 136. Yet another embodiment of the insulated housings 424, 434 defines grip extensions or ribs molded thereon to accommodate a more secure grip thereof when assembling and disassembling the connector 10, 110.

The female tapered insulator 420 and the male tapered insulator 430 may be fabricated from any suitable outdoor-rated material such as plastic, thermoplastic or other synthetic material. Preferably, the insulators 420 and 430 are fabricated from a thermoplastic elastomer ("TPE"), such as for example, a mixture of ethylene propylene diene monomer ("EPDM") rubber and polypropylene commercially available as such as Santoprene®, which is a registered trademark of Exxon Mobil Corporation. More particularly, the insulators 420 and 430 are fabricated from Santoprene® 101-80 or Santoprene® 201-80. The spacers 40, particularly the contact spacers 42, also may be fabricated from fabricated from any suitable outdoor-rated material such as plastic, thermoplastic or other synthetic material. Preferably, the contact spacers 42 are fabricated from a TPE, such as Santoprene®, and more particularly Santoprene® 101-80 or Santoprene® 201-80. The use of thermoplastic contact spacers 42 universalizes the thermoplastic the insulators 420 and 430, therefore a universal molded housing can accommodate the fabrication of the insulators 420 and 430 which can be used on all standard power distribution cables, such as for example Type W Single Conductor Portable Round Power Cable, ranging in size from 2 AWG Type W Portable Power Cable through 4/0 AWG Type W Portable Power Cable.

Figure 15:
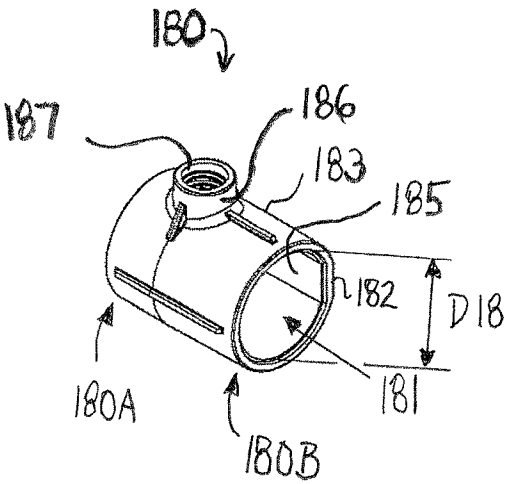
FIG. 15 is a perspective view of one embodiment of a crush ring for use with the portable power connector of FIG. 4.

One embodiment of the crush ring 180 for use with the portable power connector of FIG. 4 is shown in FIG. 15 and defines a first end 180A, a second end 180B, and an outer surface 183. The crush ring 180 defines a bore 181 therethrough for receiving one of the female contact 126 or the male contact 136 therein (FIGS. 5 and 6). The bore 181 defines an inner diameter "D18". Preferably, D18 is in the range of about 0.875 inch to about 1.0 inch, and more particularly in the range of about 0.95 inch to about 1.0 inch. In one embodiment, the outer surface 183 defines a flat portion or a flat 185 for ease of alignment during installation of the crush ring 180 within one of the female or male insulators 420 and 430.

As further shown in FIG. 15, the crush ring 180 defines a circular mount 186 extending radially outwardly from the outer surface 183 and defining an aperture 187 designed to receive a correspondingly sized and/or threaded retaining screw (not shown) therein. As described above with respect to the female and male connector s 120 and 130 of FIG. 6, the retaining screw 170 is received within the corresponding aperture 128, 138 in the respective female and male connector s 120 and 130 to secure the assembly of the respective female and male contacts 126 and 136 therein. The retaining screw 170 also engages the aperture 187 in the crush ring 180 to secure a proper alignment therein. In one embodiment, the aperture 187 in the crush ring 180 threadedly receives the retaining screw 170.

Figure 16:
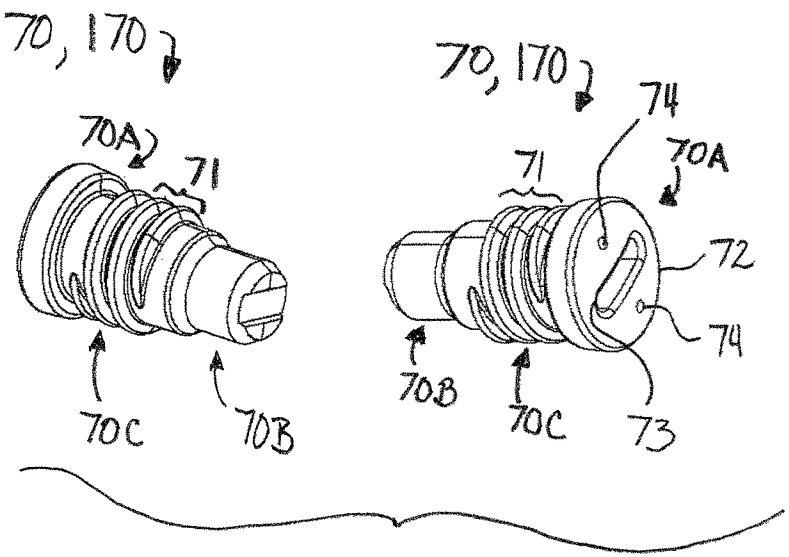
FIG. 16 is a perspective view of one embodiment of a retaining screw for use with the portable power connector of FIG. 1 or FIG. 4.

As described above with respect to the female connectors 20, 120 and the male connectors 30, 130 of FIGS. 3 and 6, the retaining screw 70, 170 is received within the corresponding apertures 28, 128 and 38, 138 in the respective female and male connectors 20, 120 and 30, 130 to respectively secure the assembly of the female connectors 26, 126 and male connectors 36,136 therein. The retaining screw 170 also is received within the corresponding aperture 187 in the crush ring 180 to secure a proper alignment in the female and male connectors 120 and 130 of FIG. 6. As shown in FIG. 16, the retaining screw 70, 170 defines a first end 70A, a second end 70B, and a midsection 70C. The midsection 70C of the retaining screw 70, 170 defines an externally threaded portion 71 designed to engage and be received within the correspondingly threaded apertures 28, 128 and 38, 138 in the respective female and male connectors 20, 120 and 30, 130, and the corresponding aperture 187 in the crush ring 180.

The first end 70A of the retaining screw 70, 170 defines a head 72 having a slot 73 defined therein designed to receive a tool, such as for example a screw driver, for properly engaging the retaining screw 70, 170 within the corresponding threaded apertures as described above. In one embodiment, the head 72 of the retaining screw 70, 170 defines one or more cavities 74 also defined to receive a corresponding tool therein. In one embodiment, the second end 70B defines a slot 75 extending axially partway therein for ease of installation and proper alignment within the female and male connectors 20, 120 and 30, 130, and the crush ring 180.

The crush ring 180 and the retaining screw 70, 170 may be fabricated from any suitable outdoor-rated material such as plastic, thermoplastic or other synthetic material. Preferably, the crush ring 180 and the retaining screw 70, 170 are fabricated from a high strength, abrasion and impact resistant thermoplastic polyamide formulation commonly known as nylon. One embodiment of the crush ring 180 and the retaining screw 70, 170 is fabricated from Zytel®, which is a registered trademark of DuPont. Fabricating the retaining screw 70, 170 from a non-conductive material provides for increased safety during installation of the retaining screw 70, 170 and use of the connector 10, 110; and also provides the retaining screw 70, 170 with fast running threads for quick assembly.

Figure 17C:
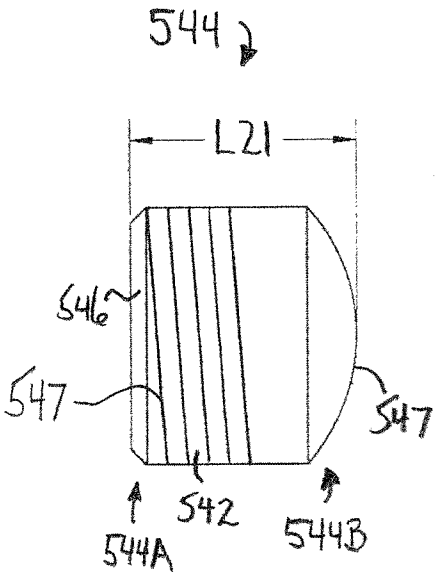
FIG. 17C is a side schematic view of the set screw of FIG. 17A.
Figure 17B:
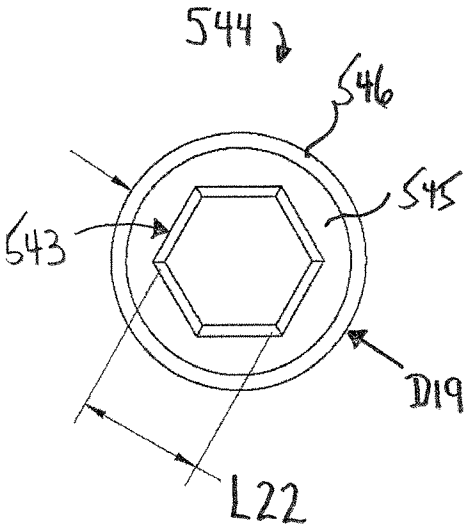
FIG. 17B is a top schematic view of the set screw of FIG. 17A.
Figure 17A:
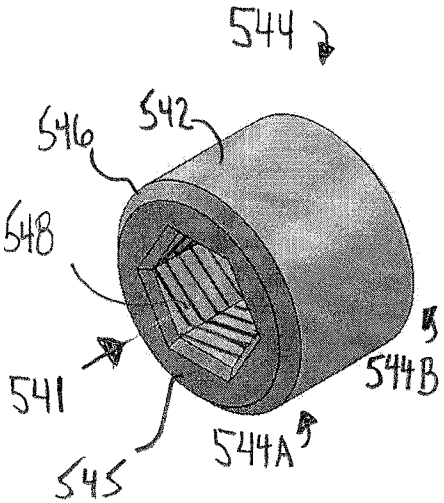
FIG. 17A is a perspective view of one embodiment of a set screw for use with the portable power connector of FIG. 1 or FIG. 4.
Figure 18A:
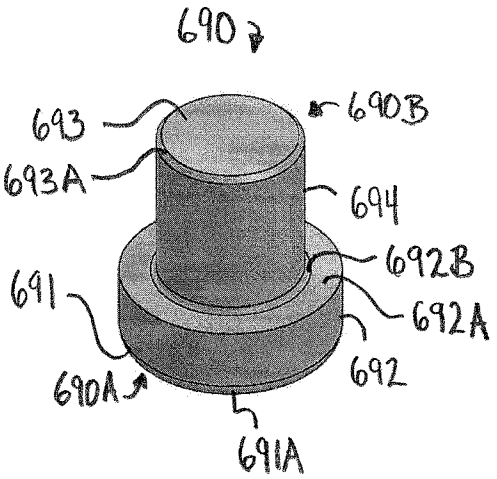
FIG. 18A is a perspective view of one embodiment of a cam pin for use with the portable power connector of FIG. 1 or FIG. 4.
Figure 18B:
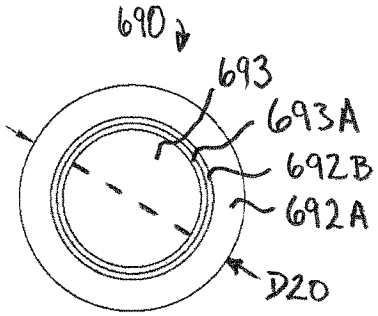
FIG. 18B is a top schematic view of the cam pin of FIG. 18A.
Figure 18C:
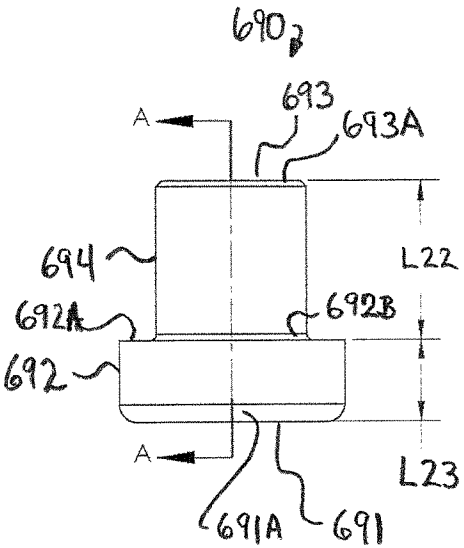
FIG. 18C is a side schematic view of the cam pin of FIG. 18A.
Figure 18D:
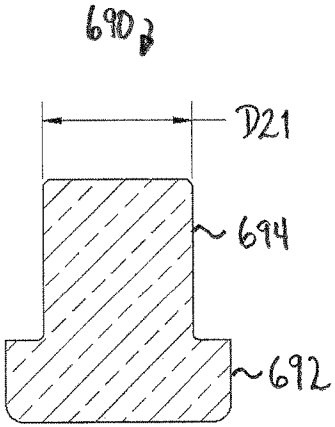
FIG. 18D is a cross-section view of the cam pin of FIG. 18C taken along line A-A of FIG. 18C.

As described above with reference to FIG. 3, one or more of set screws 44 are received within apertures 45 of the contact spacers 42 and corresponding apertures 27 in female contact 26 and corresponding apertures 37 in male contact 36 to respectively provide proper alignment of the female and male contacts 26 and 36 within the contact spacers 42. Similarly, one or more of set screws 44 are received within apertures 45 of one of the contact spacers 42 to provide proper alignment of the male contact 36 within the contact spacer 42. As shown in FIGS. 17A-17C, a set screw 544 defines a first end 544A, a second end 544B, an outer surface 542, and a bore 541 extending at least partway therethrough. The set screw 544 further defines a first end face 545 and a second end face 547. Preferably, the first end face 545 defines a chamfer 546. In one embodiment, the second end face 547 terminates in an oval point as shown in FIG. 17C. The set screw 544 defines an outer diameter "D19" and an overall length "L21". Preferably, D19 is in the range of 0.375 inch to about 0.625 inch, and more particularly in the range of about 0.5 inch. Preferably, L21 is in the range of about 0.5 inch to about 0.625 inch, and more particularly in the range of about 0.56 inch.

In one embodiment, the bore 541 defines a configuration adapted to receive a correspondingly configured tool therein, such as for example, the bore 541 defines a hexagonal configuration 543 having a distance "L22" between opposing sides to accommodate receiving a correspondingly sized hexagonal wrench therein. Preferably, L22 defines a conventionally sized hexagonal wrench such as, for example, L22 is about 0.25 inch to accommodate receiving a 0.25 inch hexagonal wrench therein. In one embodiment and as shown in FIG. 17A, the bore 541 and/or the hexagonal configuration 543 of the set screw 544 defines an internal thread for receiving an external thread of a retaining screw such as for example the externally threaded portion 71 of the retaining screw 70 (FIG. 16).

As shown in FIG. 17C, the set screw 544 defines an external thread 547 that threadedly engages the apertures 227 in female contact 226 (FIG. 7) and the apertures 237 in male contact 236 (FIG. 8) to engage and secure the female and male contacts 126 and 136 with exposed wire or strands of the cable and assure electrical communication therewith. The set screw 544 engages the stripped or stranded wires of the cable to provide electrical communication between such wires to the brass female and male connectors 26, 126 and 36, 136 to ensure that the connectors distribute power to the desired application. The height L21 of the set screw 544 is reduced to accommodate cables having a larger diameter (lower gauge). Similarly, the height L21 of the set screw 544 is increased to accommodate cables having a smaller diameter (higher gauge). The set screw 544 may be fabricated from any suitably rigid material such as for example, metal, plastic and other synthetic materials. In one embodiment, the set screw 544 is fabricated from an alloy steel with a zinc finish such as a zinc plating.

As described above with reference to FIGS. 9E and 10E, the cam pin 290, 390 is installed within the aperture 219, 319 defined in the second portion 202, 302 of the female contact 226, 326. As shown in FIGS. 18A-18D, a cam pin 690 defines a first end 690A and a second end 690B, a first end face 691 and a second end face 693, and a first portion 692 and a second portion 694. In one embodiment, the first end face 691 defines a chamfer 691A and the second end face 693 defines a chamfer 693A. The first portion 692 defines a back face 692A and transition chamfer 692B leading to the second portion 694. The first portion 692 defines an out diameter "D20" and a length L23; and the second portion 694 defines an out diameter "D21" and a length "L22". Preferably, D20 is in the range of about 0.125 inch to 0.25 inch, and more particularly in the range of about 0.188 inch. Preferably, D21 is in the range of up to about 0.125 inch. Preferably, L22 is in the range of about 0.125 inch to 0.15 inch, and more particularly in the range of about 0.14 inch. Preferably, L23 is in the range of about 0.05 inch to 0.075 inch, and more particularly in the range of about 0.065 inch to about 0.07 inch.

The cam pin 290, 390 is installed within the aperture 219, 319 defined in the second portion 202, 302 of the female contact 226, 326 to ensure secure engagement and electrical communication with the cam groove 258, 358 defined in the second portion 252, 352 of the male contact 236, 336 the male contact 236, 336. Such engagement provides a twist lock connection that assures such secure engagement and electrical communication and also that resists vibration.

Figure 19A:
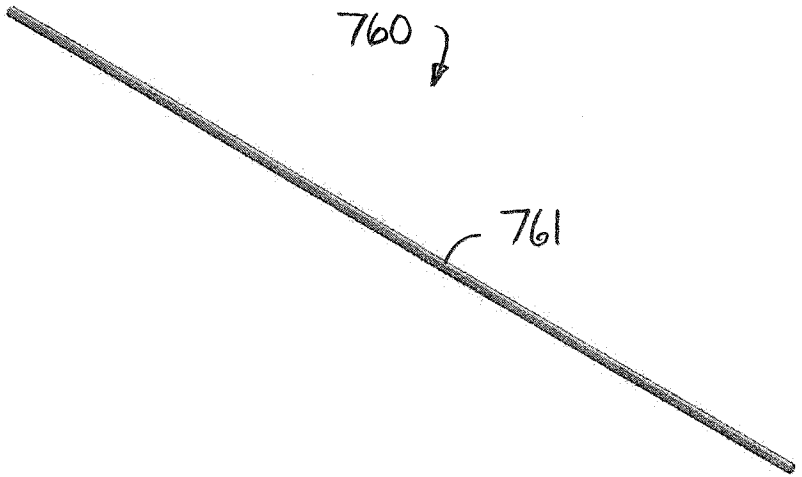
FIG. 19A is a perspective view of one embodiment of a strain relief for use with the portable power connector of FIG. 1 or FIG. 4.
Figure 19B:
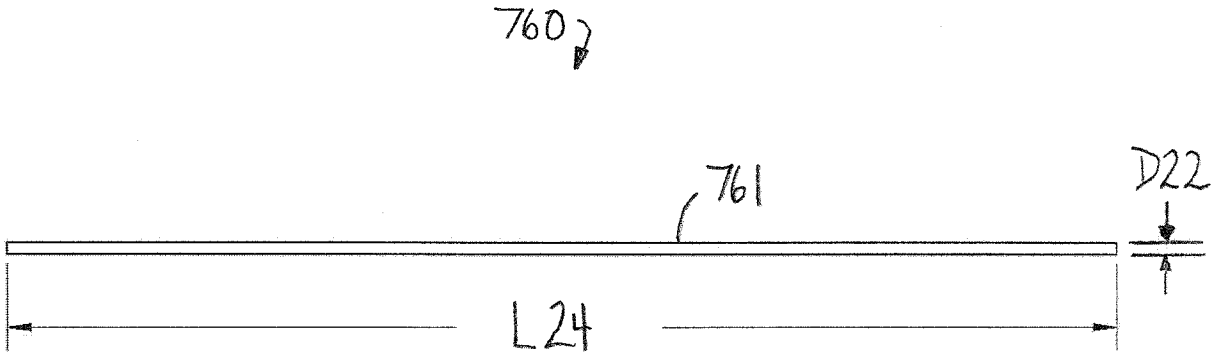
FIG. 19B is a schematic view of the strain relief of FIG. 19A.

As described with reference to FIGS. 3 and 6, one or more members, wires or rods 60, 160 are installed within the connector 10, 110 to provide for strain relief. As shown in FIGS. 19A-19C, a strain relief rod 760 comprises a rod 761 having an outer diameter "D22" and a length "L24". Preferably, D22 is in the range of about is in the range of about 0.05 inch to about 0.07 inch, and more particularly in the range of about 0.0635 inch to about 0.065 inch. Preferably, L24 is in the range of about is in the range of about 5.875 inches to about 6.125 inches, and more particularly in the range of about 6 inches. The rod 761 engages or is tied into the cable to provide relief from separation of the connector 10, 110 when a separation force is applied thereto.

The cam pin 690 may be fabricated from any suitably rigid material such as for example metal, plastic or other synthetic material. One embodiment of the cam pin 690 is fabricated from a brass alloy. The cam 690 is preferably fabricated from brass along with the female contact 226, 236, or the male contact 236, 336, to generate high contact mating pressure for reduced operating temperature and longer life of the components. Similarly, the strain relief rod 760 may be fabricated from any suitably rigid material such as for example metal, plastic or other synthetic material. One embodiment of the strain relief rod 760 also is fabricated from a brass alloy.

Figure 20A:
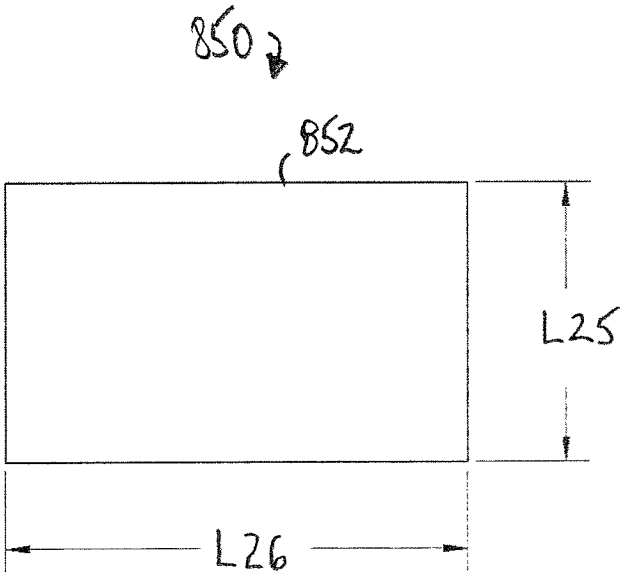
FIG. 20A is a top schematic view of one embodiment of a cable wrap for use with the portable power connector of FIG. 1 or FIG. 4.
Figure 20B:
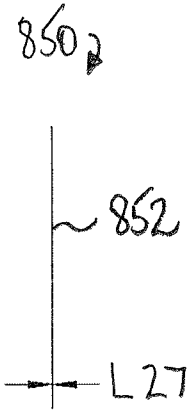
FIG. 20B is a side schematic view of the cable wrap of FIG. 20A.

As described with reference to FIGS. 3 and 6, the exposed wire or strands of the cable are wrapped with a contact foil 50, 150 and the wrapped strands of the cable are inserted into the female and male contacts 26, 126 and 36, 136. As shown in FIGS. 20A-20B, a contact foil 850 comprises a substantially flat foil sheet 852 having a first dimension or height "L25", a second dimension or length "L26", and a third dimension or width "L27". Preferably, L25 is in the range of about is in the range of about 1.25 inches to about 1.75 inches, and more particularly in the range of about 1.5 inches. Preferably, L26 is in the range of about is in the range of about 2.25 inches to about 2.75 inches, and more particularly in the range of about 2.5 inches. Preferably, L27 is in the range of about is in the range of up to about 0.01 inch, and more particularly in the range of about 0.005 inch.

The contact foil 850 is wrapped around or over the stripped or stranded wires of the cable such that all areas of the cable strands make positive contact to or within the female and male contacts 26, 126, 36, 136 after such connectors have been assembled. The contact foil 850 may be fabricated from any suitably malleable material, preferably an electrically conductible material, such as for example metal foil. One embodiment of the contact foil 850 is fabricated from a copper foil comprised of an annealed copper alloy.

Simple and efficient installation of the connector 10, 110 and its components described above is accommodated wherein an installer simply aligns the flat 207, 307 defined on the female contact 226, 326, with the flat 185 defined on the crush ring 180 and the flat 424C defined in molded housing 424 of the female insulator 420. Similarly, an installer simply aligns the flat 264, 364 defined on the male contact 236, 336, with the flat 185 defined on the crush ring 180 and the flat 434C defined in molded housing 434 of the male insulator 430. After the components are aligned, the retaining screw 70, 170 is aligned and set in place. Aligning the respective flats of the respective components prevents rotation of the electrically conductive components inside the insulator 420, 430 thereby facilitating the assembly of the connectors 10, 110, and maintaining the integrity of the connectors 10, 110 while connecting and disconnecting the power cables.

Figure 21A:
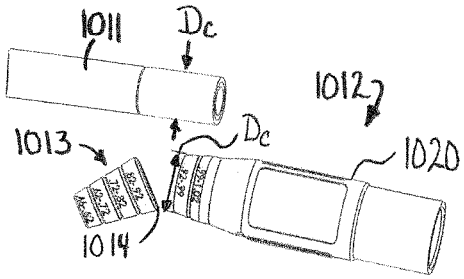
FIGS. 21A-21H provide a graphical representation of a method of assembling and installing a female and male connector of FIG. 1 or FIG. 4 on a cable.
Figure 21B:
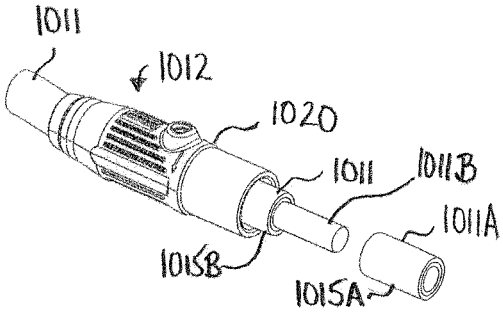
Figure 21C:
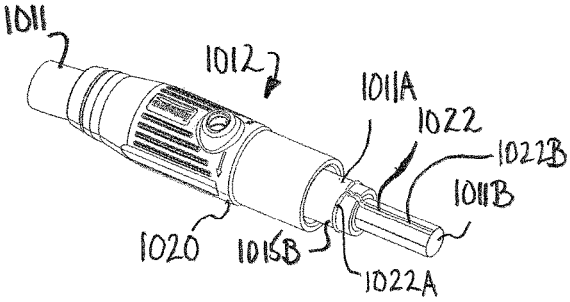
Figure 21D:
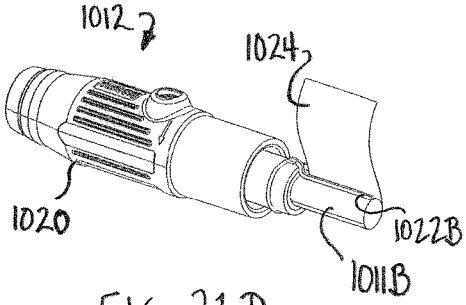
Figure 21E:
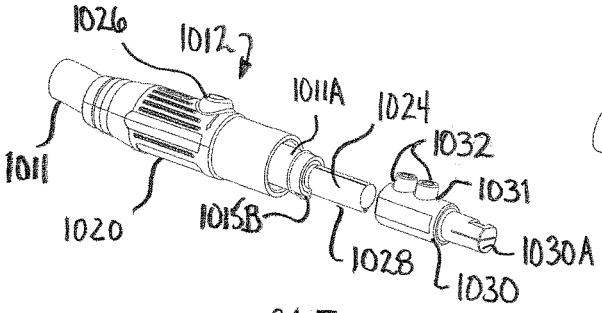
Figure 21F:
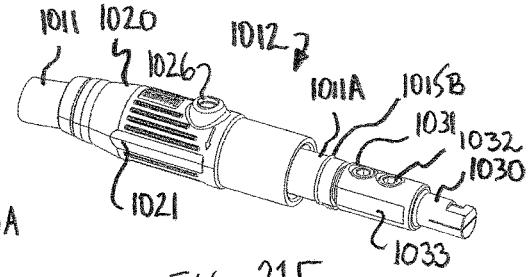
Figure 21G:
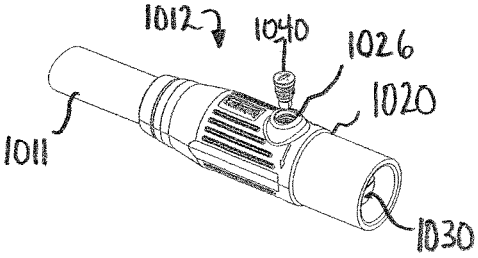
Figure 21H:
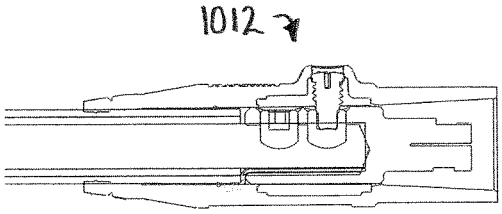

A method for assembling and installing one of a female or male connector 1012 on a cable 1011 is illustrated in FIGS. 21A-21H. As shown in FIG. 21A, step 1 includes measuring a diameter "$D_C$" of cable 11, identifying a corresponding tapered segment 1013 of an insulator 1020 of a connector 1012, and cutting the insulator 1020 at a groove 1014 located immediately axially aft or outward of the selected tapered segment 1013. As shown in FIG. 21B, step 2 includes lubricating cable 1011 with a cable pulling lube, sliding cable 1011 through the insulator 1020, and stripping or otherwise removing a portion 1015A of cable insulation 1011A to expose a wire or conductor 1011B. Optionally, step 2 includes sliding cable 1011 through one or more crush rings (not shown) and then sliding the cable 1011 and the crush ring(s) into the insulator 1020. As shown in FIG. 21C, step 3 includes securely wrapping a portion 1022A of a strain relief member or wire 1022 around a remaining portion 1015B of cable insulation 1011A, and extending a portion 1022B of the strain relief wire 1022 along the exposed conductor 1011B. As shown in FIG. 21D, step 4 includes wrapping a conductive foil 1024 tightly around exposed conductor 1011B and the portion 1022B of the strain relief wire 1022 to form a wrapped conductor 1028 (FIG. 21E). Step 4 further includes trimming the foil 1024 and the strain relief wire 1022 to terminate proximate to the termination of the conductor 1011B.

Continuing with FIG. 21 E, step 5 includes rotating the insulator 1020 on the cable 1011 until the portion 1022B of the strain relief wire 1022 is positioned diametrically opposite a retaining screw aperture 1026 formed in the insulator 1020. Step 5 further includes selecting an electrically conductive contact 1030 from among a female and male contact (as illustrated a male contact 1030A), and inserting the wrapped conductor 1028 into the contact 1030 while maintaining the positioning of the strain relief wire 1022 in relation to the retaining screw aperture 1026. The contact 1030 comprises a double set screw contact and includes two allen-drive set screws 1032 threadedly engaged in two corresponding apertures 1031 of the contact 1030. As shown in FIG. 21F, step 6 includes further threadedly engaging the set screws 1032 within the corresponding apertures 1031 of the contact 1030 to achieve in the range of 200 lb-in of torque, and assuring that the set screws 1032 are flush with contact 1030. Step 6 further includes aligning a flat side or flat 1033 of contact 1030 with a flat feature or flat 1021 of insulator 1020, and guiding the contact 1030 into the insulator 1020. In one embodiment, crush rings are As shown in FIG. 21G, step 7 includes assuring that the contact 1030 is fully seated within the insulator 1020 such that the threaded retaining screw aperture 1026 is aligned with at least one of the set screws 1032, preferably the set screw 1032 positioned closest to the end of the conductor 1011B. Step 7 further includes driving a retaining screw 1040 into the threaded retaining screw aperture 1026 of the insulator 1020 to achieve in the range of to 15 lb-in of torque thereby locking the contact 1030 in place. A cross section of a completed assembly of the connector 1012 is provided in FIG. 21H.

A method for connecting a female connector 1120 and male connector 1130 is illustrated in FIGS. 22A and 22B and includes aligning the retaining screws 1040 of each connector 1120 and 1130 and pushing the connectors 1120, 1130 together, and turning one connector 1120, 1130 in the range of about 90° to about 180° with respect to the other connector 1120, 1130 to lock the connectors 1120, 1130 together.

As described above, the connectors 10, 110 are provided for use with 2 AWG Type W Portable Power Cable through 4/0 AWG Type W Portable Power Cable. FIG. 23 provides a device ampacity table wherein an allowable rating is provided and is based on use of the connectors 10, 110 in an open air environment with an ambient temperature of about 30° C. (86° F.). For example, a connector 10, 110 provided for use with 75° C. 2 AWG Type W Portable Power Cable is rated at 170 amps while a connector 10, 110 provided for use with a 90° C. 4/0 AWG Type W Portable Power Cable is rated at 400 amps.

Another embodiment of the present invention includes a method for assembling and installing a power connector on a cable. The method includes providing a power connector having a first end, a second end, and a midsection. The method further includes providing a female connector having a tapered female insulator defining a first taper extending radially outwardly from the first end and tapering axially inward to the midsection, and a female contact defining a first set screw contact having at least one first radial aperture. A male connector is also provided having a tapered male insulator defining a second taper extending radially outwardly from the second end and tapering axially inward to the midsection, and a male contact defining a second set screw contact having at least one second radial aperture. A first set screw engages the at least one first radial aperture and a second set screw engages the at least one second radial aperture. Each of the first and second set screws define an outer surface and a bore extending at least partway therethrough. A first retaining screw engages the bore of the first set screw and corresponding aperture in the female connector. A second retaining screw engages the bore of the second set screw and corresponding aperture in the male connector.

In one embodiment, the method further includes coupling the female and male connectors with one of a 2 AWG Type W Portable Power Cable through 4/0 AWG Type W Portable Power Cable. In one embodiment, the method further includes engaging and placing in electrical communication the female connector of one electrical connector with the male connector of another electrical connector. In one embodiment, the method further includes providing a double set screw contact as at least one of the female and male contacts. In one embodiment, the method further includes providing at least one spacer and engaging the at least one spacer within at least one of the first and second radial apertures respectively defined in the female and male contacts. In one embodiment, the method further includes providing a double set screw contact spacer as the at least one spacer. In one embodiment, the method further includes providing at least one set screw and engaging the at least one set screw within at least one aperture defined in the spacer and at least one of the first and second radial apertures respectively defined in the female and male contacts. In one embodiment, the method further includes providing at least one crush ring and engaging the at least one crush ring within at least one of the female and male insulators.

In one embodiment, the method further includes wrapping an electrically conductive foil around exposed wires of the cable. In one embodiment, the method further includes providing a strain relief member within the connector. In one embodiment, the method further includes selectively sizing a tapered segment of the tapered female and male insulators to receive a selectively sized cable therein. In one embodiment, the method further includes installing a cam pin within a cam pin aperture defined in the female contact of the female connector; and engaging the cam pin with a cam groove defined with the male contact of the male connector so that the cam groove receives and is in electrical communication with the cam pin. In one embodiment, the method further includes engaging an externally threaded portion of each of the first and second set screws with the respective at least one first and second radial apertures. In one embodiment, the method further includes engaging an external thread defined in each of the first and second retaining screws with an internal thread defined in the bore of each of first and second set screws.

In one embodiment, the method further includes aligning a first flat portion defined in a housing of the female insulator with a second flat portion defined on an outer diameter of the female contact, and aligning a third flat portion defined in a housing of the male insulator with a fourth flat portion defined on an outer diameter of the male contact. In one embodiment, the method further includes inserting a first crush ring within the female insulator, inserting a second crush ring within the male insulator, aligning a fifth flat portion defined on an outer surface of the first crush ring with the first flat portion defined in the housing of the female insulator and the second flat portion defined on the outer diameter of the female contact, and aligning a sixth flat portion defined on an outer surface of the second crush ring with the third flat portion defined in the housing of the male insulator and the fourth flat portion defined on the outer diameter of the male contact.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A method for assembling and installing a power connector on a cable, the method comprising:

providing a power connector having a first end, a second end, and a midsection;

providing a female connector having;

a tapered female insulator defining a first taper extending radially outwardly from the first end and tapering axially inward to the midsection, and a female contact defining a first set screw contact having at least one first radial aperture;

providing a male connector having;

a tapered male insulator defining a second taper extending radially outwardly from the second end and tapering axially inward to the midsection; and a male contact defining a second set screw contact having at least one second radial aperture;

engaging a first set screw within the at least one first radial aperture and engaging a second set screw within the at least one second radial aperture, each of the first and second set screws defining an outer surface and a bore extending at least partway therethrough;

engaging a first retaining screw within the bore of the first set screw and corresponding aperture in the female connector; and engaging a second retaining screw the bore of the second set screw and corresponding aperture in the male connector.

2. The method for assembling and installing a power connector on a cable of claim 1 further comprising:

coupling the female and male connectors with one of a 2 AWG Type W Portable Power Cable through 4/0 AWG Type W Portable Power Cable.

3. The method for assembling and installing a power connector on a cable of claim 1 further comprising:

engaging and placing in electrical communication the female connector of one electrical connector with the male connector of another electrical connector.

4. The method for assembling and installing a power connector on a cable of claim 3 further comprising:

installing a cam pin within a cam pin aperture defined in the female contact of the female connector; and engaging the cam pin with a cam groove defined with the male contact of the male connector so that the cam groove receives and is in electrical communication with the cam pin.

5. The method for assembling and installing a power connector on a cable of claim 1 further comprising:

providing a double set screw contact as at least one of the female and male contacts.

6. The method for assembling and installing a power connector on a cable of claim 1 further comprising:

providing at least one spacer and engaging the at least one spacer within at least one of the first and second radial apertures respectively defined in the female and male contacts.

7. The method for assembling and installing a power connector on a cable of claim 6 further comprising:

providing a double set screw contact spacer as the at least one spacer.

8. The method for assembling and installing a power connector on a cable of claim 6 further comprising:

providing at least one set screw and engaging the at least one set screw within at least one aperture defined in the spacer and at least one of the first and second radial apertures respectively defined in the female and male contacts.

9. The method for assembling and installing a power connector on a cable of claim 1 further comprising:

providing at least one crush ring and engaging the at least one crush ring within at least one of the female and male insulators.

10. The method for assembling and installing a power connector on a cable of claim 1 further comprising:

wrapping an electrically conductive foil around exposed wires of the cable.

11. The method for assembling and installing a power connector on a cable of claim 1 further comprising:

providing a strain relief member within at least one of the female connector and the male connector.

12. The method for assembling and installing a power connector on a cable of claim 1 further comprising:

selectively sizing a tapered segment of the tapered female and male insulators to receive a selectively sized cable therein.

13. The method for assembling and installing a power connector on a cable of claim 1 further comprising:

selectively sizing a plurality of tapered segments of at least one of the tapered female and male insulators to receive a selectively sized standard cable therein.

14. The method for assembling and installing a power connector on a cable of claim 1 further comprising:

engaging an externally threaded portion of each of the first and second set screws with the respective at least one first and second radial apertures.

15. The method for assembling and installing a power connector on a cable of claim 14 further comprising:

engaging an external thread defined in each of the first and second retaining screws with an internal thread defined in the bore of each of first and second set screws.

16. The method for assembling and installing a power connector on a cable of claim 1 further comprising:

engaging an external thread defined in each of the first and second retaining screws with an internal thread defined in the bore of each of first and second set screws.

17. The method for assembling and installing a power connector on a cable of claim 1 further comprising:

aligning a first flat portion defined in a housing of the female insulator with a second flat portion defined on an outer diameter of the female contact; and aligning a third flat portion defined in a housing of the male insulator with a fourth flat portion defined on an outer diameter of the male contact.

18. The method for assembling and installing a power connector on a cable of claim 17 further comprising:

inserting a first crush ring within the female insulator;

inserting a second crush ring within the male insulator;

aligning a fifth flat portion defined on an outer surface of the first crush ring with the first flat portion defined in the housing of the female insulator and the second flat portion defined on the outer diameter of the female contact; and aligning a sixth flat portion defined on an outer surface of the second crush ring with the third flat portion defined in the housing of the male insulator and the fourth flat portion defined on the outer diameter of the male contact.

* * * * *